United States Patent [19]

Asari et al.

[11] Patent Number: 4,669,291

[45] Date of Patent: Jun. 2, 1987

[54] SPINNING TYPE MULTIPLE ROLLER FORMING MACHINE

[75] Inventors: Akira Asari, Hyogo; Takashige Yamamura; Shigeo Hattori, both of Kobe; Tsuneya Ueno, Hyogo; Satoshi Matsumoto, Osaka; Takayoshi Dosai, Hyogo; Fumikazu Ohtsuki, Kobe; Kazuhiro Fujimoto, Kobe; Toshimitsu Takahashi, Kobe, all of Japan

[73] Assignee: Kabushiki Kaisha Kobe Seiko Sho, Kobe, Japan

[21] Appl. No.: 810,602

[22] Filed: Dec. 19, 1985

[30] Foreign Application Priority Data

| | | | |
|---|---|---|---|
| Dec. 19, 1984 | [JP] | Japan | 59-193441[U] |
| Dec. 19, 1984 | [JP] | Japan | 59-269436 |
| Feb. 26, 1985 | [JP] | Japan | 60-27917[U] |
| Jul. 11, 1985 | [JP] | Japan | 60-105853[U] |
| Oct. 31, 1985 | [JP] | Japan | 60-168982[U] |

[51] Int. Cl.[4] ..... B21D 22/16

[52] U.S. Cl. ..... 72/83; 72/85

[58] Field of Search ..... 72/68, 81, 82, 83, 84, 72/85, 110, 239, 424

[56] References Cited

U.S. PATENT DOCUMENTS

| | | | |
|---|---|---|---|
| 1,104,559 | 7/1914 | Sharp | 72/424 |
| 3,287,951 | 11/1966 | Widera | 72/85 |
| 3,418,838 | 12/1968 | Rotert et al. | 72/239 |
| 3,477,264 | 11/1969 | Sohlemann | 72/81 |
| 3,517,534 | 6/1970 | Werner et al. | 72/83 |
| 4,457,152 | 7/1984 | Svagr | 72/78 |

FOREIGN PATENT DOCUMENTS

| | | | |
|---|---|---|---|
| 193724 | 11/1984 | Japan | 72/83 |
| 561106 | 4/1975 | Switzerland | 72/84 |

*Primary Examiner*—Lowell A. Larson

*Attorney, Agent, or Firm*—Oblon, Fisher, Spivak, McClelland & Maier

[57] ABSTRACT

An improved multiple roller spinning machine for spinning vehicle one-piece wheels is disclosed in which the roller holder is capable of sliding in a direction parallel with the axis of spinning and has a hydraulic cylinder which moves through its axially movable piston rod the holder horizontally thereby bringing the multiple rollers sequentially in to an operating position just above the wheel material clamped between the dies of the driving and driven spindles. Each of the multiple rollers is coupled to a control hydraulic cylinder which drives through its piston the respective roller vertically between a retracted position and a drawing position where the roller is pressed against the periphery of the wheel material. Thus, not only can the sequence of different drawing steps, in a most preferable embodiment, from rough to finishing drawing, be completed in an automatic continued manner, but also operation of the hydraulic cylinder to shift the holder, with the particular roller pressed against the material periphery being set in spinning, causes the roller to draw a wider range than its size across the U-cross section portion of the periphery. According to another embodiment, the holder carries therein multiple rows of different forming rollers arranged radially about a common center such that the wheel material can be subject to drawing by multiple rollers simultaneously applied at different points about the material periphery.

3 Claims, 31 Drawing Figures

FIGURE 4 *PRIOR ART*
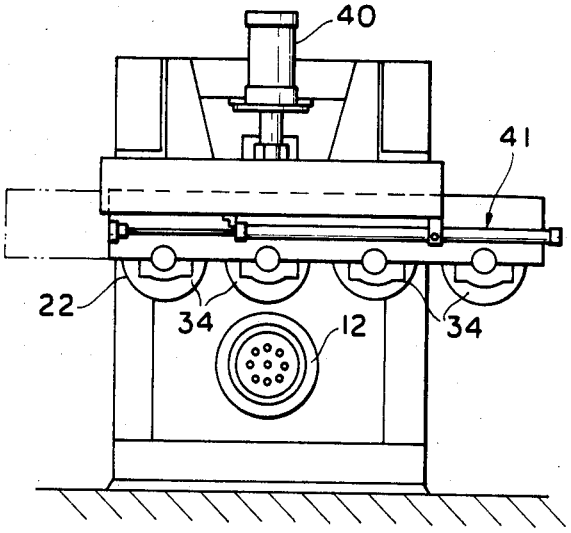
FIGURE 5 *PRIOR ART*
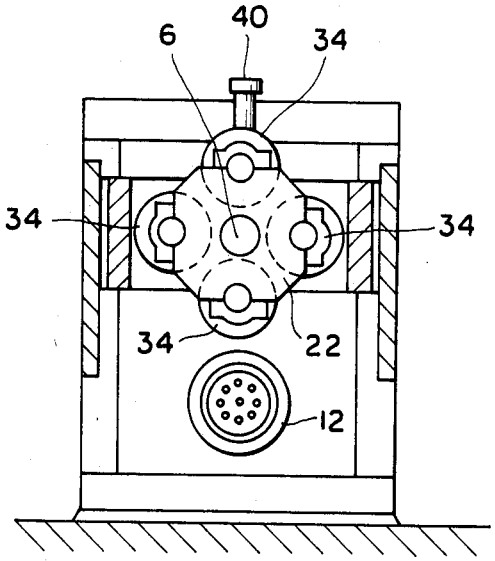

SPINNING TYPE MULTIPLE ROLLER FORMING MACHINE

BACKGROUND OF THE INVENTION (1) Field of the Invention

The present invention relates in general to a multiple roller spinning machine for spinning vehicle wheels, and in particular to various improvements in such a machine. The improvement include means for sliding the roller holder horizontally in a direction parallel with the axis of spinning to thereby enable the roller to draw a range wider than its size across the U-cross section portion of the wheel material outside periphery, means for replacing the roller holder, means for replacing the multiple rollers, and means for feeding work, centering it between the rotating spindles, and discharging it at the end of the spinning in an automatic manner.

(2) Description of the Prior Art

Wheels for buses, trucks and general passenger cars may be produced by spinning from workpiece or wheel materials shaped like a drum flanged on either side, of largely U- or V-cross section along its outside priphery, so formed at the previous process stage. In typical spinning, the wheel material, while being spun about its own axis between the headstock main spindle and tailstock driven spindle, is subjected at its U-cross section outside periphery to drawing by a roller.

The headstock main spindle and the tailstock driven spindle are held in axial alignment with each other and rotated at a very high speed about their axis by an external drive. They each carry at their forward end a die formed at its surface with a particular profile or contour. In fact, between the dies of both spindles is clamped the wheel material, with both of its largely concaved circular sides tightly pressed against the profiled die faces, and set into high speed rotation. Roller drawing at the outside priphery of the wheel material during revolution enables it to assume the profile of the dies underneath at that outside periphery. As a result of spinning, the wheel material may be transformed to the cross section depicted in FIG. 3(4) from its original shape as shown in FIG. 3(1).

A typical conventional spinning machine has a single forming roller, normally elliptical in cross section. However, it is generally difficult or often impossible for a single roller to draw the wheel material from its initial simple shape, as shown in FIG. 3(1), to a desired final profile as a vehicle wheel. In some instances, therefore, a set of rollers different in shape and size, each designed for a different sequential step of drawing, from rough to finishing drawing, are employed, and are assembled into the roller holder one after another according to the progress of the drawing operation.

In other instances, the holder shifts its roller in a direction perpendicular with the axis of spinning to thereby enable it to draw at different points across the U-cross section rim of the wheel material. In this manner, the one and the same roller can draw a ranger wider than its size. In either example, operation demands considerable time and repeated cycles of jobs, changing or shifting the roller over and over again, with resultant low productivity, and have not been acceptable, particularly in mass-scale production.

Japanese utility model No. 57-152227 has been proposed to solve some of these problems. It discloses a multiple roller spinning machine having a set of different rollers assembled in the holder to perform different steps of the operation in an automatic continued manner. In one embodiment of the invention taught in this utility model application, the multiple rollers 34 are arranged in a linear row in the holder 22, as shown in FIG. 4. The holder 22 is coupled at one end thereof to a hydraulic cylinder 41 which moves through its axially movable piston rod the holder in a direction parallel with the axis of spinning to thereby bring the multiple rollers sequentially into a position just above the wheel material clamped between the dies of the driving and driven spindles. Also, the holder 22 is coupled at its top to another hydraulic cylinder 40 which moves its axially movably piston cylinder through the holder 22 vertically. In operation, the hydraulic cylinder 40 is actuated to bring the roller now just above the wheel material into pressure contact against its rim for drawing, the material being spun at high speed between the dies. When the drawing is completed by this roller, the hydraulic cylinder 41 is actuated to bring the next roller in for the subsequent step of drawing. In this way, the work can be subjected to drawing by multiple rollers, desirably from rough to finishing drawing.

In another embodiment, as shown in FIG. 5, the rollers 34 are arranged radially about a common center at 6 in the holder 22, and rotatably disposed for free rotation about the center 6. Rotation of the holder brings the rollers sequentially into a position just above the wheel material 12 clamped between the dies of the driving and driven spindles. The holder 22 is coupled at its top to a hydraulic cylinder 40 which moves its piston rod through the holder to thereby bring the roller now just above the material into pressure contact with the material rim. In this way, the workpiece can be subjected to drawing by multiple rollers.

Japanese utility model application No. 57-15227, while found advantageous in efficiency and, to some degree, productivity, over those single-roller spinning machines, shares many of these problems with most prior art spinning machines.

A most serious problem with the prior art is that the rollers are incapable of shifting in a direction perpendicular with the axis of spinning.

Secondly, considerable inefficiency results from the manual procedure of feeding the wheel material to be spun, centering it between the headstock and tailstock spindles, and, at the end of the spinning process, removing it from the machine to provide room for the next material in the queue. Time and manpower involved in this manual procedure is considerable, particularly so in mass-scale production. Further, centering the material in position demands extreme effort on the part of the operator.

Thirdly, replacing the roller also consumes much labor and time. When a forming roller has to be changed in the conventional spinning machines, it is normally removed, together with its bearing, from the machine, and suspended in air with a crane or similar special hoisting device. With the roller hung in this way, tightening bolts are loosened to release the old roller, and the new roller is fitted and secured in position with the bolts. This job does not only demand an extremely long time of concentrated labor, but it also tends to expose the operator to a hazadous condition due to the danger of possible injury by impact from a swinging or accidentally falling roller bearing. Further, loosening the bolts and holding the new roller in a fixed position as it is secured in the bearing are very difficult and cumbersome, since the suspended bearing easily allows swinging motion from even the slightest external force exerted on it during the work. Because of these problems in the main, those prior art spinning machines have not been widely acceptable.

SUMMARY OF THE INVENTION

The present invention contemplates to eliminate the above-mentioned various problems of the prior art spinning machine.

It is therefore a main object of the present invention to provide an improved multiple roller spinning machine of the type having a combination of rollers different in type or roller shape in which each roller permits adjustment of the force with which it is pressed against the outside periphery of a wheel material to be spun, independently of the other rollers.

It is a more particular object of the present invention to provide a spinning machine having means to slide the multiple rollers in a direction parallel with the axis of spinning, relative to the wheel material held in fixed position between the headstock and tailstock, to thereby bring them sequentially into the drawing position adjacent the material.

It is a corollary object of the present invention to provide a machine in which, using the aforesaid sliding means, the roller in the drawing position working on the material can be shifted transversly in a direction perpendicular with the axis of spinning, across the U-cross section portion of the rim, so that the roller will draw a wider range than its size.

It is another object of the present invention to provide a machine having an automatic feed means in which the wheel material to be spun is automatically fed, centered in fixed drawing position between the headstock and tailstock of the machine, and, at the end of the spinning, removed out of the machine to provide room for the next material in the queue. The incorporation of this automatic feed means contributes greatly to reducing production time and labor while increasing efficiency and safety in handling the wheel materials, particularly in mass-scale production.

It is a further object of the present invention to provide a machine having an automatic roller holder changer means consisting of T-rail track means through which both the replaced and replacing roller holders are slide by a hydraulic means both readily and in an efficient manner. This roller holder changer means may conveniently be used when the multiple rollers are changed.

It is a still further object of the present invention to provide a machine having automatic roller changer means consisting of hydraulic means for moving the multiple rollers and a tiltable platform provided adjacent the rollers onto which the rollers, when replaced, are conveyed and replaced with the new set of rollers placed in predetermined positions on the same platform in an easy manner.

The above and other objects, features and advantages of the present invention will become apparent from the following description and appended claims, taken in conjunction with the accompanying drawings which show by way of example some preferred embodiments of the invention.

BRIEF DESCRIPTION OF THE DRAWINGS

FIG. 4 is a front partially sectional view of a conventional multiple roller spinning machine in which the rollers are arranged in a linear row;

FIG. 5 is a front partially sectional view of a conventional multiple roller spinning machine in which the rollers are arranged radially with respect to a common center;

DESCRIPTION OF THE PREFERRED EMBODIMENTS

Figure 1:
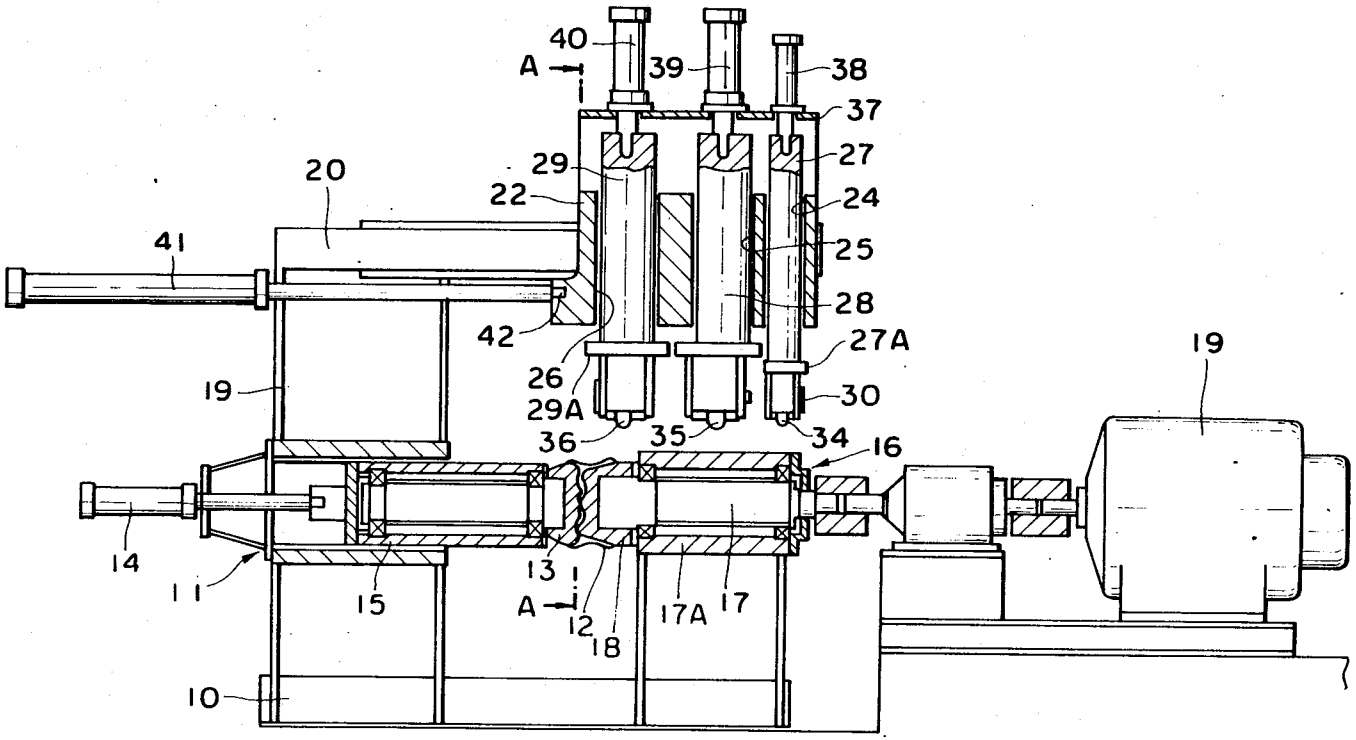
FIG. 1 is a side cross-section view of one preferred embodiment of the multiple roller spinning machine according to the present invention.

Referring first to FIG. 1, the multiple roller forming machine for profiling one-piece vehicle wheels built in accordance with the present invention includes a tailstock 11 that is mounted on the pedestal 10 of the machine.

The tailstock 11 has at its forward end a die 13 which is applied to one side of wheel material 12. The die 13 is rotatably installed on one end of a driven spindle 15 that is axially slidable disposed in the tailstock 11 for horizontal movement with respect to the fixed tailstock 11. The driven spindle 15 is connected at its opposite end with a hydraulic cylinder 14 through a piston rod which moves the die 13 in a linear direction through the driven spindle 15.

A headstock 16 is provided so as to be mounted facing the tailstock 11 and carries therein a main driving spindle 17 that is also rotatably disposed for rotation about its axis in alignment with the driven spindle 15. The driving spindle 17 has also a paired die 18 which is applied to the opposite side of the material 12 to be profiled, and is inserted in a bearing means 17A. The opposite end of the driving spindle 17 is operatively connected to a drive 19 which spins the spindle 17 about its axis.

Figure 3:
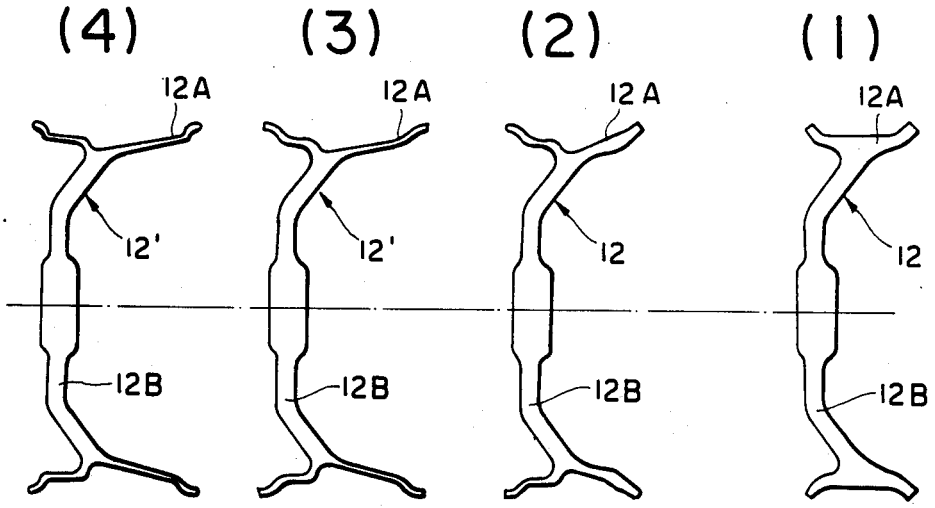
FIG. 3(1) through 3(4) are cross-section views of a wheel material at different sequential stages of spinning.

In operation, the wheel material 12 is clamped at its sides between the driving spindle 17 and the driven spindle 15, and it is subjected to the operation of a separate profiling machine along its outside periphery 12A in FIG. 3(1). The material 12 may be worked to undergo change at the periphery 12A in sequential steps as illustrated in FIG. 3(1), which shows the overall shape of a wheel material 12 prior to forming, through FIG. 3(4), which shows the final profile. The profiling machine works on the outside surfaces of flanged periphery 12A, its inside surface being held against the peripheral contours of the dies 13, 18 on both sides of the material 12.

Preferably, both dies 13 and 18 are removably attached on their respective spindle end so that they can be interchanged with a variety of different dies to accomodate the diverse profile of the wheel that may vary depending on the vehicle type.

The forming machine has a frame 19A mounted on the pedestal 10. The frame 19A has at its upper portion a pair of horizontal guide beams 20 secured in fixed position. A roller holder 22 is also mounted at an upper portion of the frame 19A and has at both sides thereof a pair of parallel horizontal grooves 21, as best shown in FIG. 2, sized to receive slidably therethrough the guide beams 20, respectively, such that the holder 22 moves horizontally in a parallel relationship with the axis of the headstock along the guide beams 20.

Preferably, each of the grooves 21 and/or the beams 20 may be coated with a liner 23 in the sliding surface so as to ease the sliding movement of the holder 22.

The holder 22 carries at its forward end a number of rollers. In this particular embodiment, the number of rollers is three. However, this number is only a matter of choice and the holder may have any number of rollers. The holder 22 has three vertical guide bores 24, 25, 26, properly spaced in the direction of sliding movement of the holder 22. In the guide bores 24, 25, 26 are slidably inserted three roller shanks 27, 28, 29, respectively.

Figure 2:
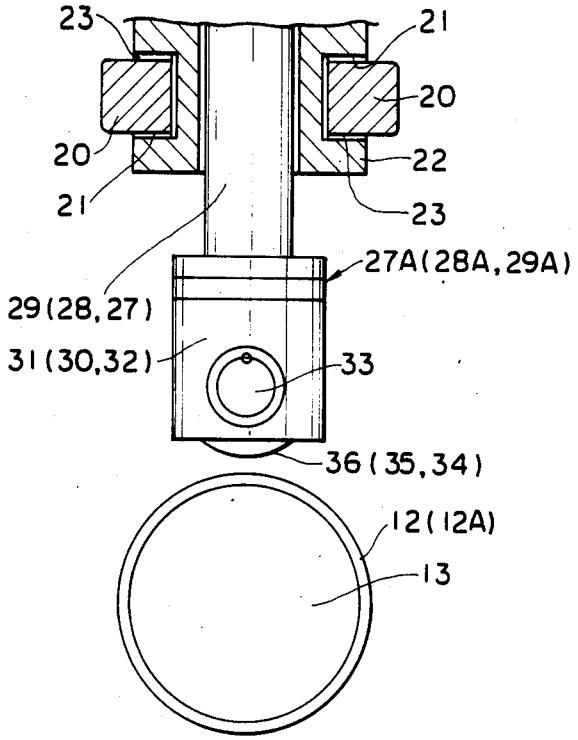
FIG. 2 is a partially cross-section view of the spinning machine, taken along the line A—A of FIG. 1.

Each of the shanks 27, 28, 29 is provided at its lower end with a bearing 30, 31, or 32 through a flanged bolt coupling 27A, 28A, 29A, as best shown in FIG. 2. Each of the bearings 30, 31, 32 carries a forming roller 34, 35 or 36 that is rotatably disposed within the bearing for free rotation about an horizontal axis 33 parallel with the axis of the driving spindle 17. The bearings 30, 31, 32 may preferably be detachably secured to their respective shanks in order to allow changing of the different rollers. Preferably, the rollers 34, 35, 36 are arranged in the holder 22 to follow the sequential steps of operation from rough to finishing profiling.

Each of the shanks 27, 28, 29 is operatively connected to a hydraulic cylinder 38, 39, or 40 through its telescopic piston rod which drives the respective shank in a vertical direction. These hydraulic cylinders 38, 39, 40 are installed in positions on a mounting base 37 that is provided on top of the holder 22, and can be individually operated to bring their respective roller into pressure contact against the outside periphery 12A of the wheel material 12 for profiling, independently of one another.

The roller holder 22 is connected at its rear end with a hydraulic cylinder 41 through its telescopic piston rod. Proper operation of this hydraulic cylinder 41 can move the holder 22 horizontally in steps along the guide beams 20, thereby bringing the rollers 34, 35, 36 sequentially into operating position at the wheel material 12. The piston rod of the hydraulic cylinder 41 may be releasably screw connected at its forward end to the rear end wall of the holder 22 at 42.

With the above arrangement, operation of the multiple roller forming machine will be described in detail. When the wheel material 12, fed into the machine from a proper feed mechanism (not shown), is held in a centered position adjacent to the headstock 16 between the driven spindle 15 and driving spindle 17 that are now spaced apart from each other, the hydraulic cylinder 14 is operated to cause the driven spindle 15 to move toward the headstock 16 until the material 12 is clamped at its disk portion 12B between the paired dies 13, 18.

Preferably, one of the dies 13, 18, more desirably the die 13, may be provided with a center projection long enough to penetrate into the center hole of the material 12 when it is clamped between the dies 13, 18, so that the wheel material will be positioned in correct alignment with both spindles 15, 17.

When the material 12 is clamped in a centered position between the dies 13, 18, the drive 19 is energized to drive the driving spindle 17, thus causing the material 12 to rotate about its own axis.

With the material 12 being kept rotating, the hydraulic cylinder 41 is operated to move the holder 22 backward from the position shown in FIG. 1 until the roller 34 is carried over to a point just above the material 12 between the dies 13, 18. The hydraulic cylinder 38 then is operated to bring the roller 34 into proper pressure contact against the outside periphery 12A of the material 12. Since the material is spun at high speed, pressure exerted on the outside surface of the flanged periphery 12A causes a deformation in the contour of the die.

Further, desired forming may be optimized by slightly shifting the roller 34 in the direction parallel with the axis of the spindles, so that the roller can thus perform a drawing action over a range larger than its size. This is done by manipulating the hydraulic cylinder 41 to inch the holder 22 in one or both directions as required. Thus, the roller 34 may draw the material 12 into the profile illustrated in FIG. 3(2).

When the drawing by the roller 34 is completed, the hydraulic cylinder 38 is actuated to cause the roller 34 to retract to its original neutral position. Then, the hydraulic cylinder 41 is operated to inch the holder 22 properly bringing the next forming roller 35 into an operating position just above the rotating material 12, now roughly profiled at its outside periphery 12A. Similarly, the hydraulic cylinder 39 is operated to drive the roller 35 into pressure contact against the periphery 12 of the material 12 in rotation. Also, with the roller 35 held against the rotating material 12, the hydraulic cylinder 41 may be operated to shift the holder 22 and hence the roller 35 so that drawing occurs over a wider range in the flanged periphery 12A. Thus, the material may be drawn at the rim 12A into the profile depicted in FIG. 3(3).

Following a procedure similar to the above, at the end of the forming operation by the roller 35, such is retracted back to its neutral position and the holder 22 is further inched to bring the last roller 36 into operating position, which takes its turn for finishing work. Likewise, with the roller 36 pressed against the outside periphery 12A of the rotating material 12, the roller 36 may be moved in a direction parallel with the axis of the spindles 15, 17 through the hydraulic cylinder 41, to obtain a wider range of drawing. Thus, the finishing roller 36 may draw the material 12 into the final profile of the formed wheel material shown in FIG. 3(4).

The wheel material 12 thus profiled at its outside periphery 12A is then removed from the spinning machine by a suitable knockout mechanism (not shown) and carried on a conveyor or other transport means to subsequent stages for further processing.

Further, since each roller is operated by its hydraulic cylinder through the roller shank, adjusting the hydraulic cylinder can control the force with which the roller is pressed against the rim of the wheel material. In addition, the multiple rollers can draw with a different pressure by controlling their hydraulic cylinders differently.

Although, in this particular embodiment, the rollers 34, 35, 36 are arranged such that the rightmost roller 34 in FIG. 1 is operated first for rough drawing and the leftmost one 36 being used for finishing, this is only a matter of choice, and they may be reversed in array. It is important to note, however, that increased efficiency and convenience will be obtained when they are arranged in the sequential steps of spinning operation.

Figure 6:
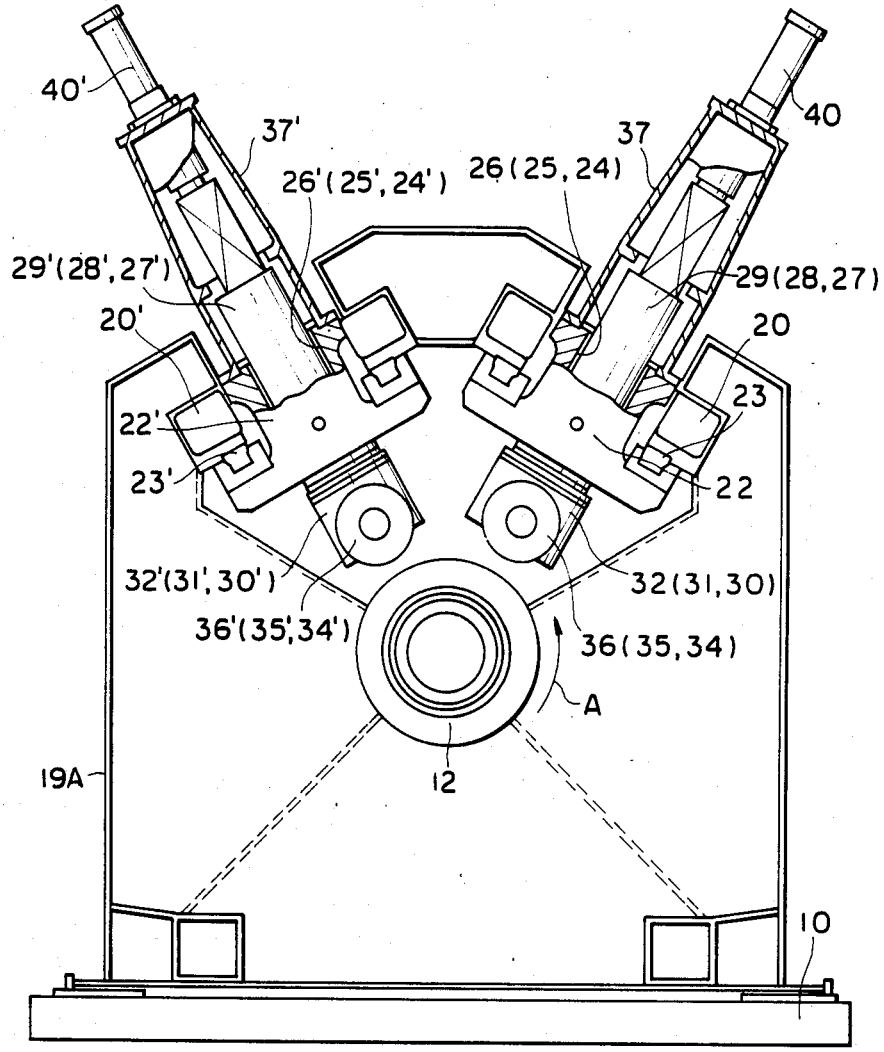
FIG. 6 is a cross-section view of the roller holder of the spinning machine according to another preferred embodiment of the present invention in which the rollers are paired and arranged symmetrically with respect to the center line of the machine.

With reference to FIGS. 1 and 6, a second embodiment of the multiple roller spinning machine of this invention will now be described. This embodiment is substantially similar to the previous embodiment except that the roller holder 22 carries therein multiple rows of various forming rollers. The rows may preferably be arranged radially about a common center parallel with the axis of spinning and can include as many as required so long as the overall design of the holder 22 permits. In this particular embodiment, the spinning machine is described as having two rows of forming rollers in the holder 22, as illustrated in FIG. 6.

The spinning machine consists of a pedestal 10, a frame 19A, a headstock 16 mounted on the pedestal 10, a driving spindle 17 axially rotatably disposed in the headstock 16, a drive means 19 for rotating the driving spindle 17 about its axis, a tailstock 11 mounted to stand facing the headstock 16, a horizontal driven spindle 15 both axially rotatably and horizontally slidably disposed in the tailstock 11 and mounted to lie in axial alignment with the driving spindle 17, and a hydraulic cylinder 14 connected through a axially movable piston rod to the rear end of the driven spindle 15 for driving the spindle 15 toward or away from the driving spindle 17. The driving spindle 17 and the driven spindle 15 each carry at their opposite ends a die 13, 18. The holder 22 in which the multiple rollers are carried has at its rear portion a pair of horizontal parallel elongated guide grooves 21 (FIG. 2) bored to receive therethrough a pair of stationary parallel beams 20 provided on the frame 19A. Also, the holder 22 is operatively connected through an axially movable piston rod to a hydraulic cylinder 41 which moves the holder 22 back and forth along the paired beams 20 to thereby bring the multiple rollers 34, 35, 36 sequentially into the operating position adjacent to the wheel material 12 clamped in fixed position between the dies 13, 18. A detailed description of the construction of the headstock and tailstock assembly and the sliding system of the roller holder has been set forth concerning the previous embodiment and is omitted here.

The holder 22 has two rows of bores 24, 25, 26 drilled to movably receive therethrough paired roller shanks 27, 28, 29, each of which carries at their lower end a forming roller 34, 35, 36. The two members of each pair is similar in construction, designated by like number with and without an apostrophy (e.g., 26, 26') in FIG. 6, and, where they are described, only one of the pairs will generally be referred to. Although, in this embodiment, the roller pairs are three in number, this is only a matter of choice and the pairs can be as many as desired so long as the overall mechanical design permits.

Each of the roller shanks 27, 28, 29 carries through a flanged bolt coupling 27A, 28A, 29A a bearing 30, 31, 32 at the lower end thereof. Each of the rollers 34, 35, 36 is rotatably housed in their respective bearing 30, 31, 32 for free rotation about a horizontal axis parallel with the axis of spinning. Also, each of the bearings 30, 31, 32 may preferably be detachably attached to their respective shank 27, 28, 29 to facilitate change of rollers. Each of the shanks 27, 28, 29 is connected at its upper end to a hydraulic cylinder 38, 39, 40 through an axially movable piston rod which drives the shank in the radial direction through its respective bore 24, 25, 26 bringing the roller now at the drawing position into contact against the wheel material rim. The hydraulic cylinders 38, 39, 40 are mounted on a mounting base 37 that is mounted on top of the holder 22, and the hydraulic cylinder 36, 39, 40 can be operated independently of one another. Also, the cylinders can be adjusted differently to control the pressure with which the roller is contacted against the rim of the wheel material 12.

Since the operation of this embodiment is substantially identical to the previous embodiment, except that the forming rollers are brought in pair into pressure contact with the outside periphery of the wheel material 12, a description thereof is omitted here. Since the two rollers are operated simultaneously, spinning can be optimized. Needless to say, the rollers may preferably be arranged in a sequential steps of operation from rough to finishing drawing. Further, the two rollers in each pair has its own hydraulic cylinder and, in operation, a desired one of the pair can selectively be used for drawing.

Referring in the main to FIGS. 7 through 12, one preferred embodiment of the roller holder changer system in accordance with the present invention will be described. In practice, this holder changer system may conveniently be used to replace the rollers as they are assembled and set on the holder. Preferably, the system may be incorporated into a multiple roller spinning machine as described above in order to increase efficiency and yield in mass-scale production. Accordingly, in describing the construction and operation of the roller holder changer system as integrated into its spinning machine, reference will be made to certain parts of the machine, particularly the roller holder. Detailed description of the spinning machine will, however, be omitted where the above description stands applicable.

Figure 13I:
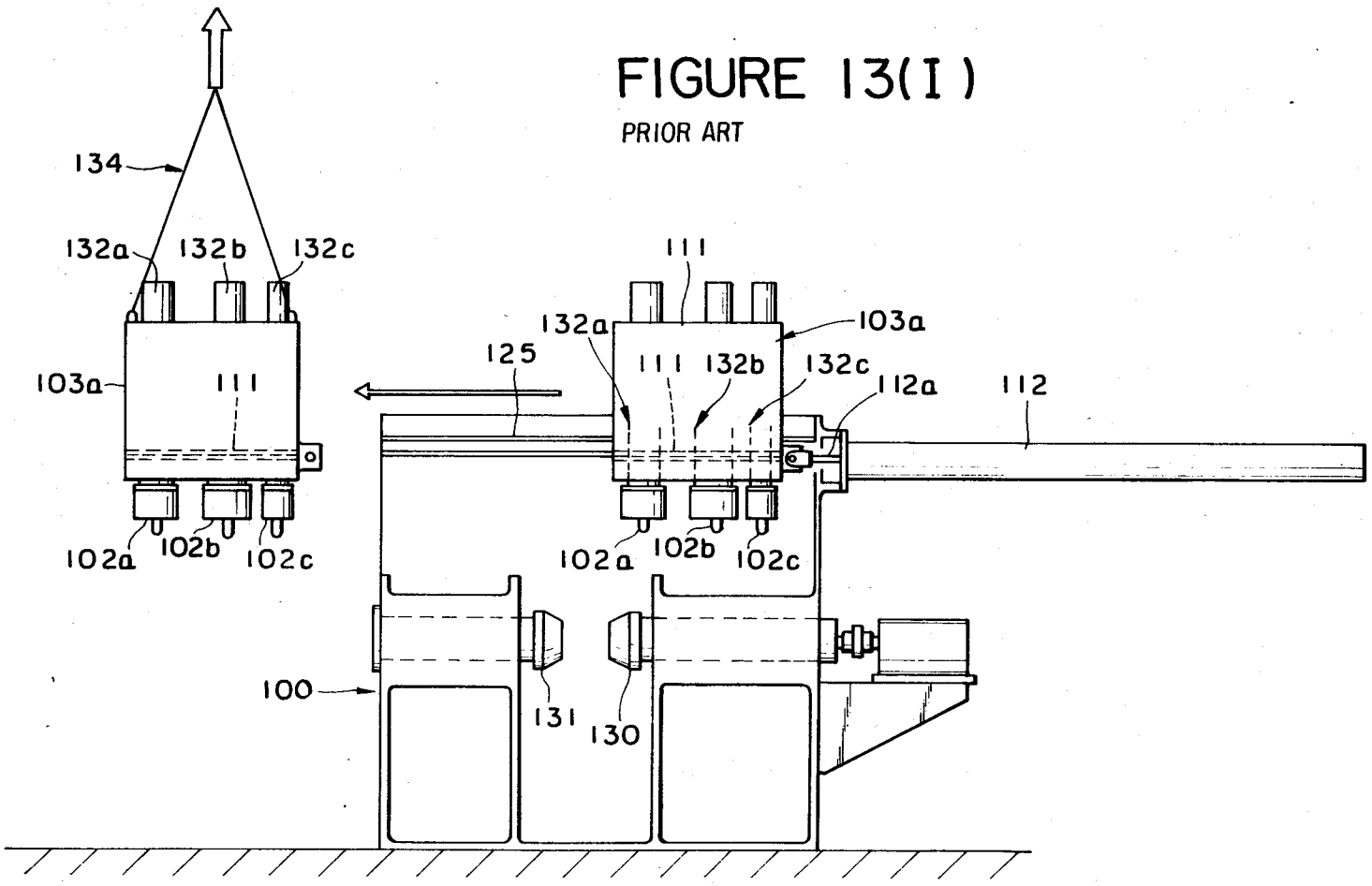
FIGURE 13(I) PRIOR ART
FIG. 13(I) shows a typical manner in which the roller holder is carried away with the crane in a replacing operation.
Figure 13:
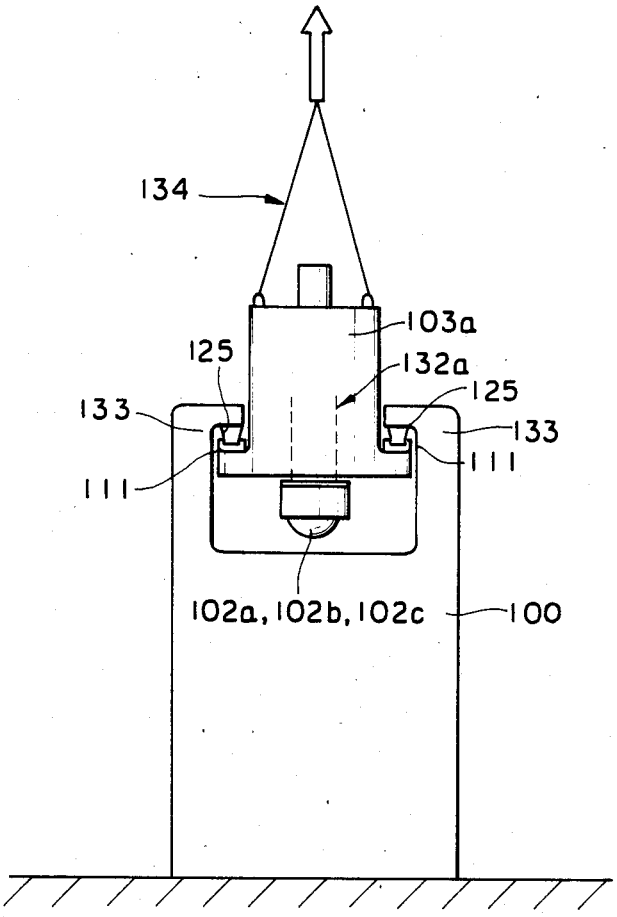
FIGURE 13(II) PRIOR ART
FIG. 13(II) shows the structure depicted in FIG. 13(I), as viewed from the front.
Figure 14:
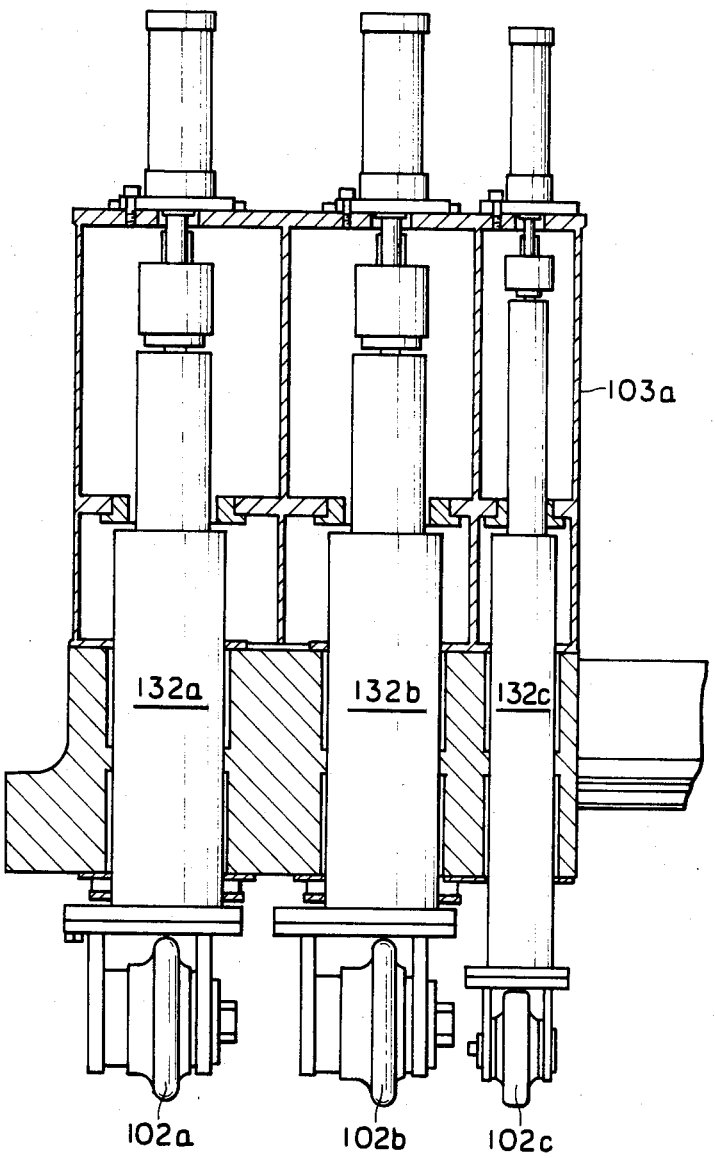
FIG. 14 is a detailed side cross-section view of the roller holder of the multiple roller spinning machine according to the present invention.
Figure 15:
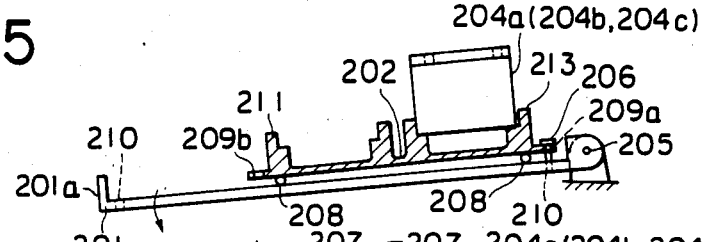
FIGS. 15(A) through 15(G) illustrate a sequential steps of replacing operations in the prefered embodiment of the changer platform of the automatic roller changer system in accordance with the present invention.
Figure 15:
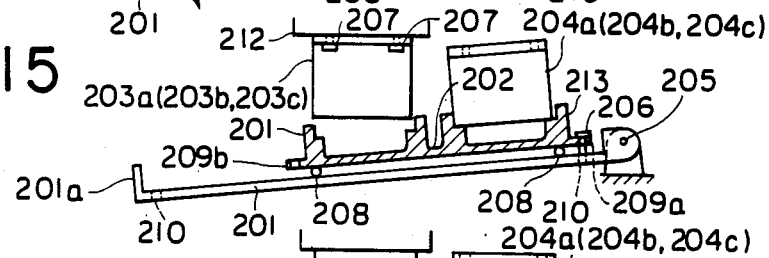
Figure 15:
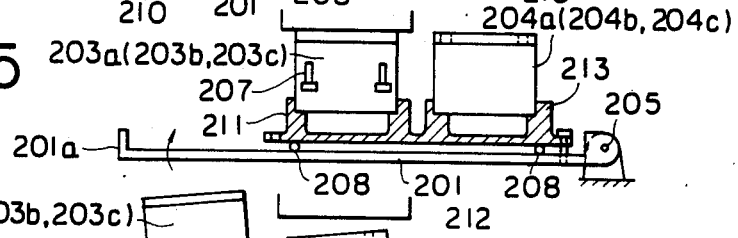
Figure 15:
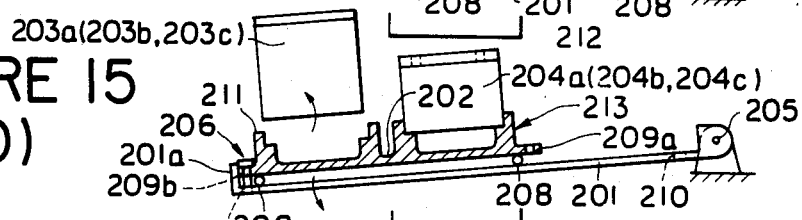
Figure 15:
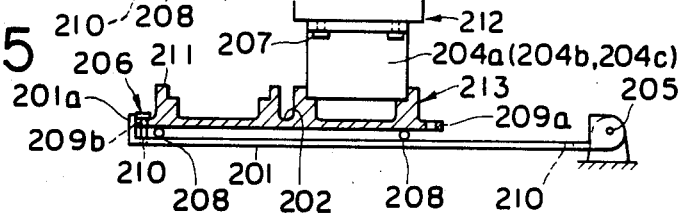
Figure 15:
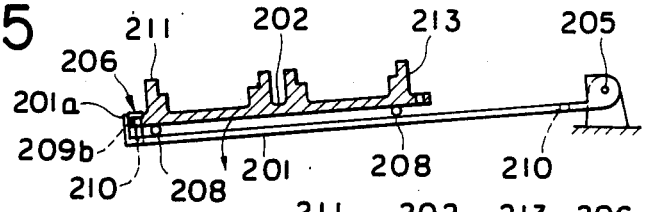
Figure 15:
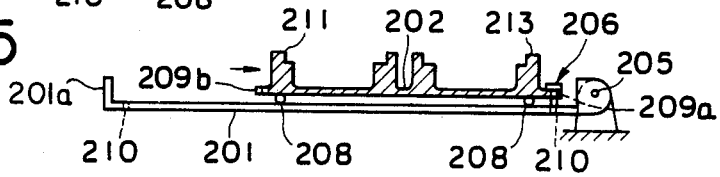

In a typical conventional roller changer system, as shown in FIGS. 13(I) and 13(II), the holder 103*a* is operatively connected at its forward end to a hydraulic cylinder 112 through an axially movable piston rod 112*a* which moves the holder 103*a* horizontally. The frame 100 of the machine has a pair of vertical walls 133 between which a rail track 125 is secured. The track 125 is adapted to slidably receive therealong a pair of sliders 111 secured in the upper side of a flanged part formed at a lower part of the holder 103*a*. In operation, the hydraulic cylinder 112 is operated to drive the holder 103*a* horizontally in the direction of the arrow. This slides the holder 103*a* along the track 125 in which the sliders 111 are engaged to guide the movement of the holder 103*a*. When the holder 103*a* is carried to the opposite end of the track 125, it is disengaged and is carried by a suitable carrier means 134 such as a crane over to a bench where the rollers are replaced with a new or different set of rollers. In providing an improvement in this type of prior art mechanism, the holder changer means according to the present invention consists of an expanded efficient T-track system, which not only eliminates the traditional use of carrier means but also optimizes the overall replacing operation.

Figure 7:
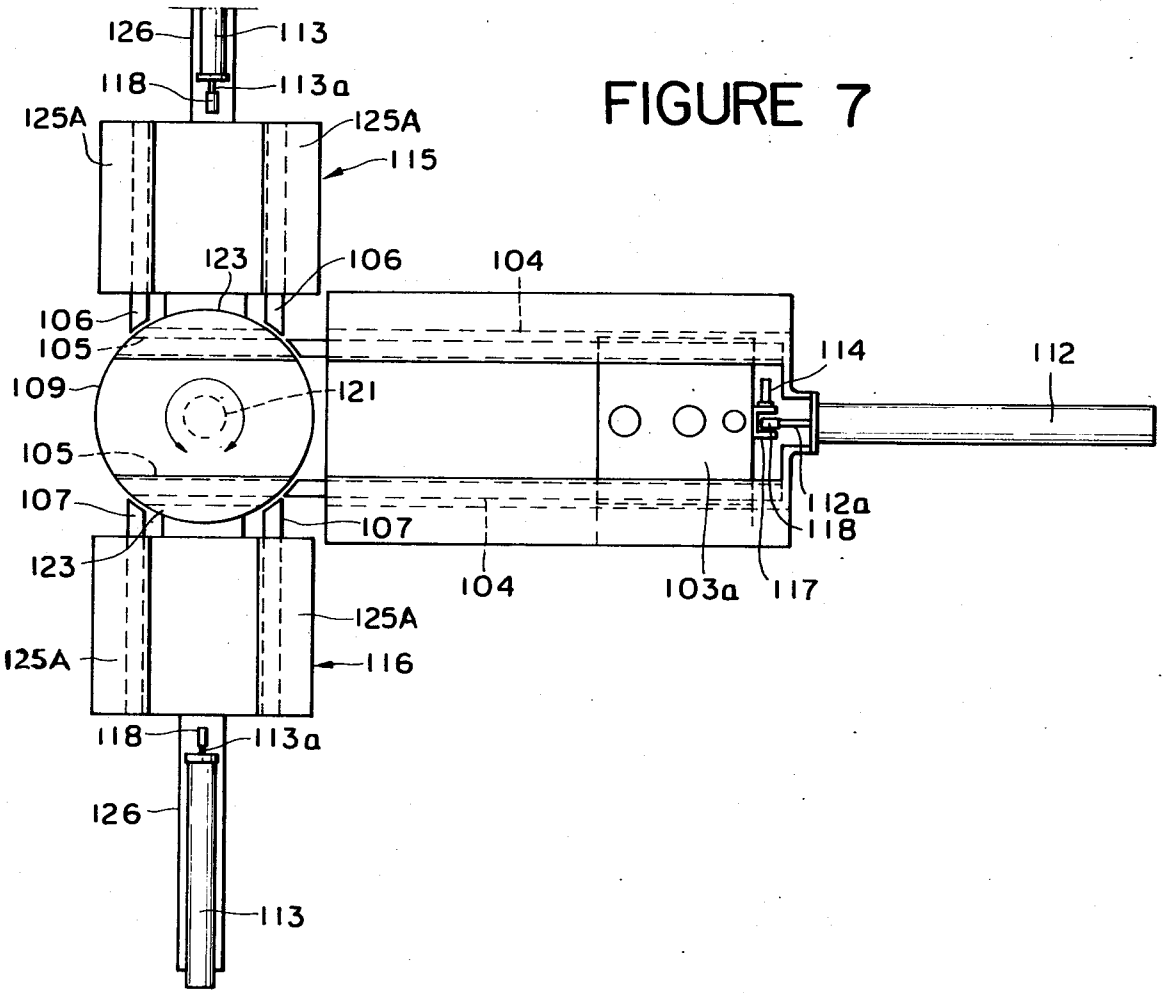
FIG. 7 is a top view of one preferred embodiment of the automatic roller holder changer system in accordance with the present invention.
Figure 8:
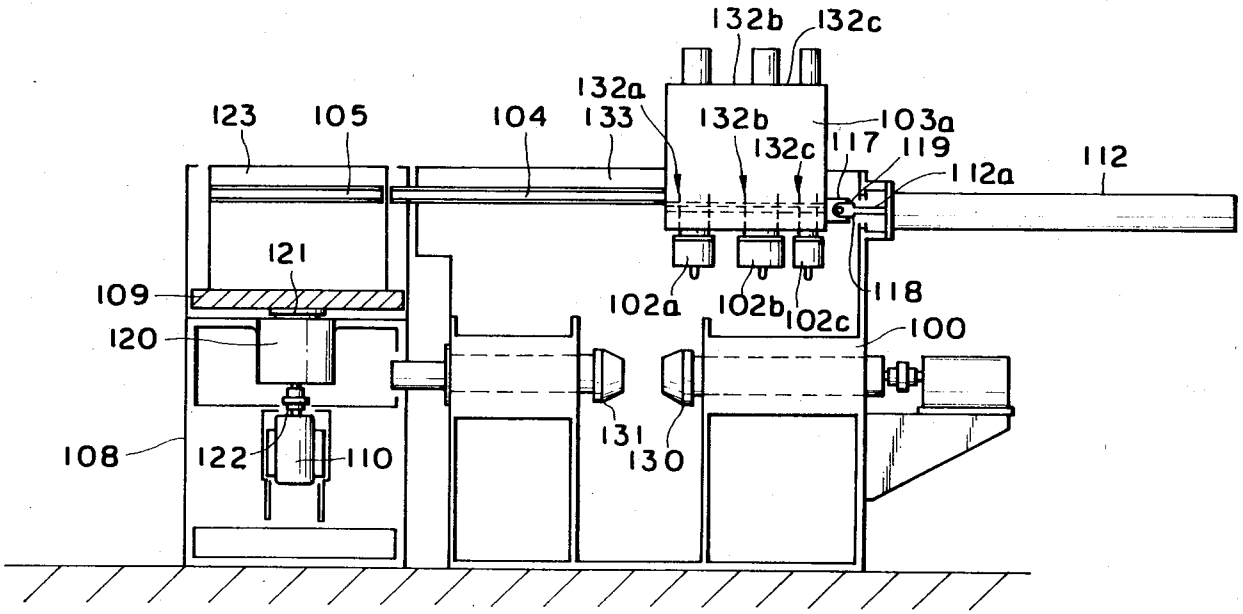
FIG. 8 is a side cross-section view of the system shown in FIG. 7, showing only its important part alone.
Figure 9:
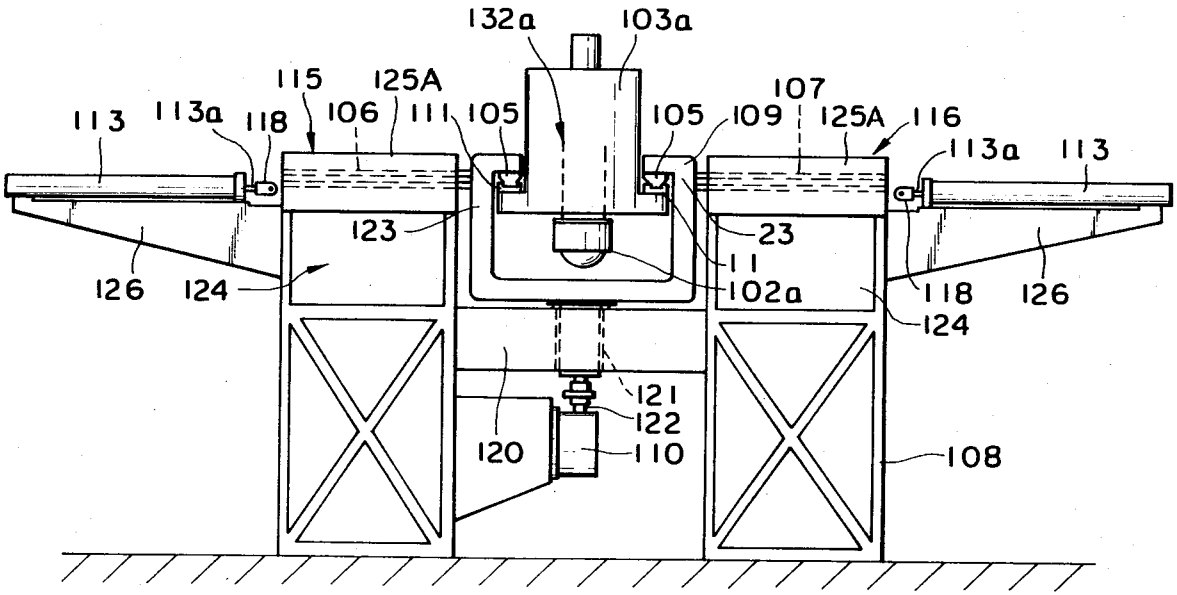
FIG. 9 is a front view of the system shown in FIG. 7.

Referring first to FIGS. 7, 8 and 9, the frame 100 of the spinning machine includes a pair of vertical walls 133 extending parallel with each other. Laid between the walls 133 is a railed track 104 that extends horizontally along the opposed surfaces of the walls. The holder 103*a*, which carries at its bottom a row of forming rollers 102*a*, 102*b* and 102*c*, has at its lower part a pair of parallel sliders 111 fixed to opposite sides thereof. The track 104 is adapted to slidably receive therealong the paired sliders 111 fittingly such that the holder 103*a* can slide back and forth along the track 104 into which the paired sliders 111 are engaged to guide the sliding movement of the holder 103*a*. A hydraulic cylinder 112 is provided at one end of the walls 133 adjacent the operating position of the holder 103*a* and operatively connected through an axially movable piston rod 112*a* to the holder 103*a*. The sliding movement of the holder 103*a* along the track 104 is provided by operating the hydraulic cylinder 112.

The forward end of the piston rod 112*a* is detachably joined to the holder 103*a* by a suitable coupling means capable of being readily fastened and released. In this embodiment, the coupling means consists of a clevis end fitting 117 secured to one end of the holder 103*a* and an eye end fitting 118 affixed to the forward end of the piston rod 112*a*. The eye end fitting 118 is inserted into the open end of the clevis end fitting 117 and a pin 114 is passed through them, as best shown in FIG. 7, to fasten the holder 103*a* with the hydraulic cylinder 112. This coupling means can easily be disengaged by pulling out the pin 114.

At the opposite end of the walls 133 is provided a turntable 109 that has a round leg 121 extending from its center downwardly. The turntable 109 is rotatably disposed in a carrier 120 enclosed in a housing 108 and has the lower end of the leg 121 connected to a motor 110 through a driving shaft 122 which rotates the turntable 109 in both directions. Also, the turntable 109 has located thereon a pair of parallel walls 123 and, between the walls 123, a railed track 105. The track 105 is adapted for connection in alignment with the track 104 so that the holder 103*a* can slide from its normal operating position all the way onto the turntable 109.

Provided on opposite sides of the turntable 109 are a pair of first and second platforms 115 and 116. Also, the first and second platforms 115, 116 have located thereon a pair of parallel walls 125A that run across both platforms. Between the walls 125A, the first platform 115 has a railed track 106 while the second platform 116 carrys another railed track 107. Both rails 106 and 107 are adapted for connection in alignment with the track 105 on the turntable 109 when the latter is rotated through 90° from its aligned position with the track 104, so that the holder 103*a* on the track 105 can be slide onto either platform 115, 116 through the track 106, 107.

In this particular embodiment, the first platform 115 is used to supply through the turntable 109 a new or replacing roller holder 103*b* to supersede the current holder 103*a*. On the other hand, the second platform 116 is adapted to receive the replaced holder 103*a* through the turntable 109. Each of the first and second platforms 115, 116 has at one end thereof a hydraulic cylinder 113 having therein an axially movably piston rod 113*a*. Affixed at the forward end of the piston rod 113*a* is an eye end fitting 118 of the same type as the fitting 118 of the piston rod 112*a*. The eye end fitting 118 provided to releasably engage with the clevis end fitting 117 on the holder 103*a*. The hydraulic cylinder 113 is supported on a fixed support 126 mounted adjacent each platform 115, 116.

In this embodiment, to ensure engagement between the rails of the tracks 104, 105, 106, 107 and the paired sliders 111 in the sliding movement of the holder 103*a*, each of the sliders has a U-shape cross section while the rails are flat or square in cross section, dimensioned to fit into the sliders 111, as best shown in FIG. 9. However, this is a matter of choice and any suitable guideway system can be employed. Also, every holder handled by this changer system is assumed to have at its opposite sides a pair of parallel sliders similar to the parallel slider 111 described above.

Figure 10:
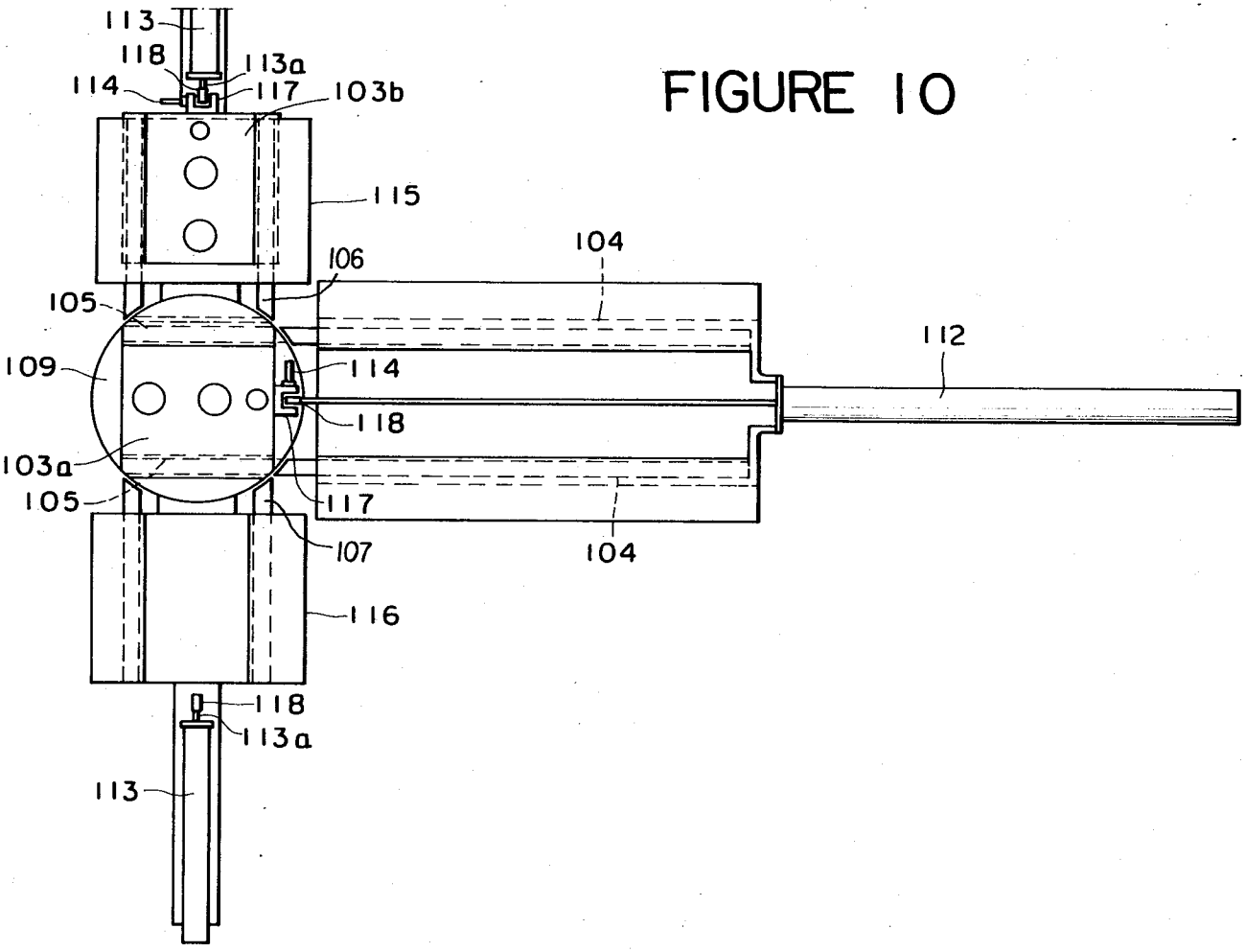
FIG. 10 is a top view of the system in FIG. 7 in which the old roller holder is being replaced with the new one.
Figure 11:
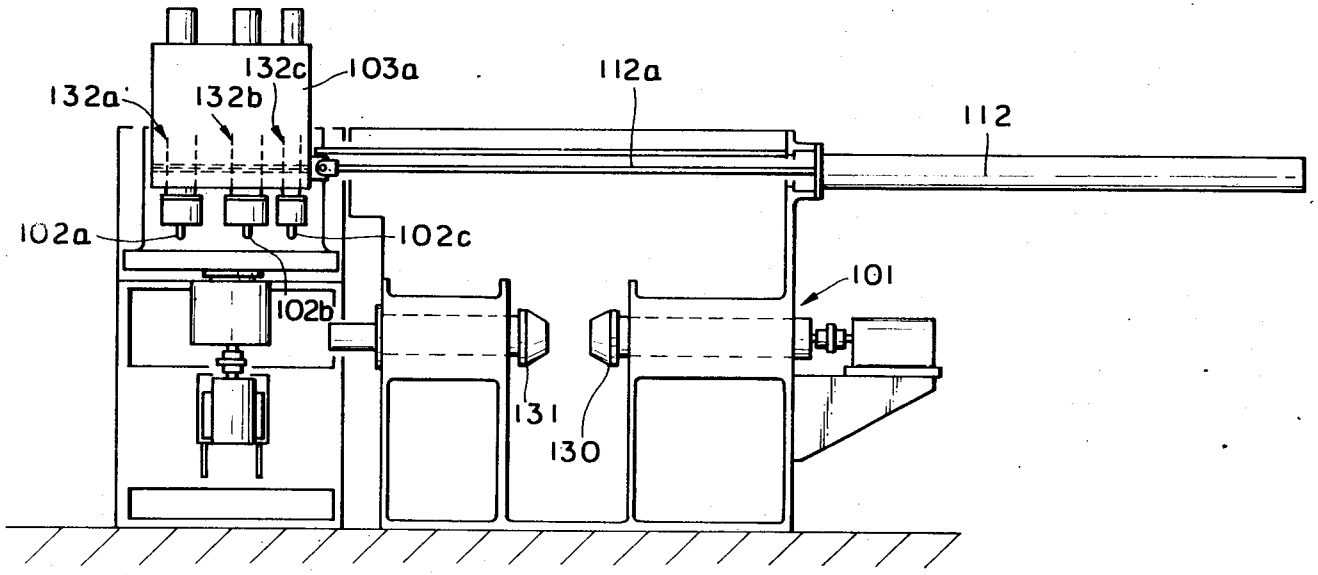
FIG. 11 is a side cross-section view of the system in FIG. 7 in which the roller holder is being replaced at the rotary changer platform.
Figure 12:
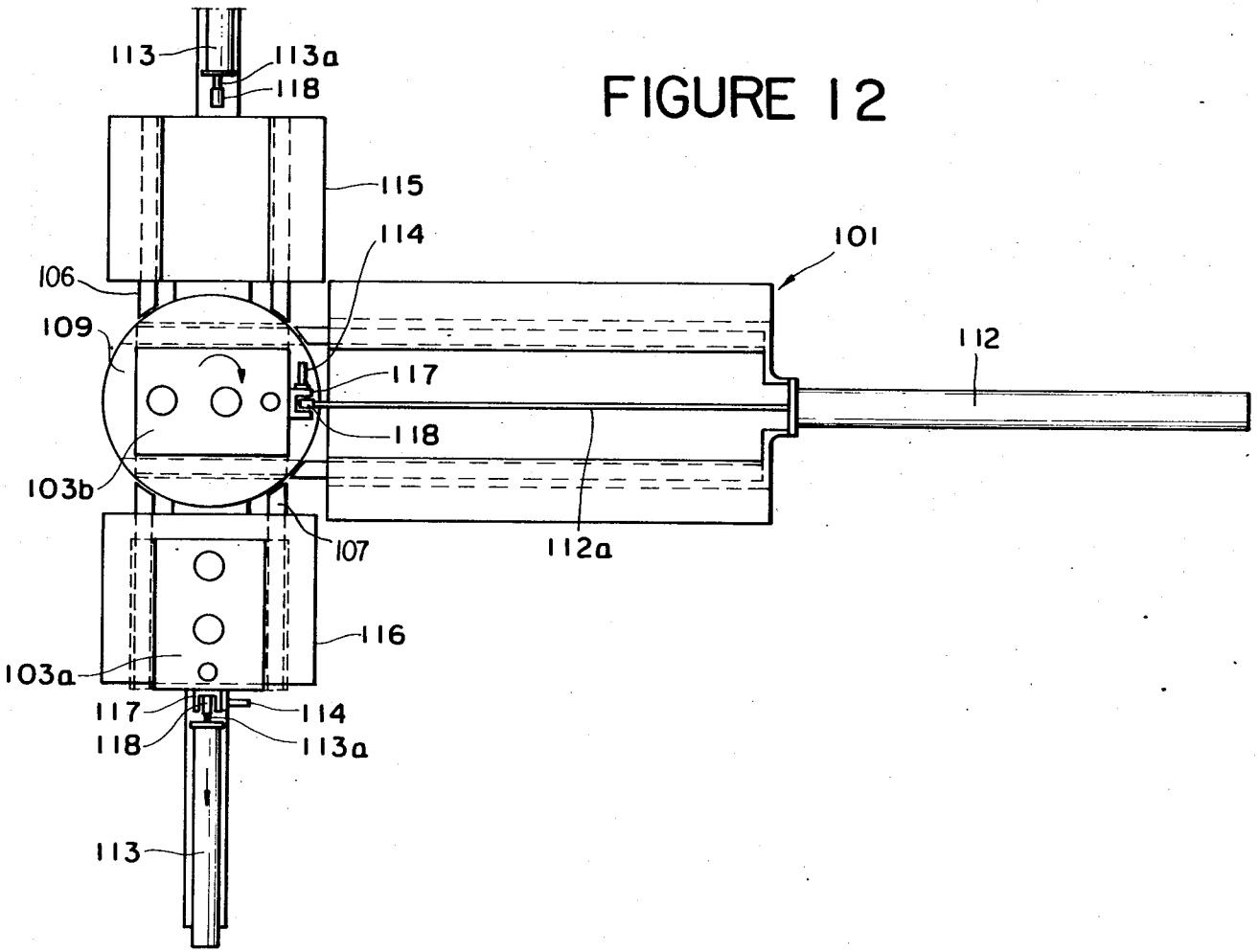
FIG. 12 is a top view of the system in FIG. 7 in which the roller holder is situated in position for being changed.

Operation of the holder changer system of this invention will be described in reference to FIGS. 10 through 12. Referring first to FIG. 10, it is to be assumed that the holder 103*a* has to be replaced for a new or different set of forming rollers with the holder 103*b*, which is already carried onto the first platform 115. First, the eye end fitting 118 of the piston rod 112*a* is engaged with the clevis end fitting 117 on the holder 103*a*, and the hydraulic cylinder 112 is then operated to drive the holder 103*a* from its operating position onto the turntable 109 along the tracks 104 and 105, where the turntable 109 is already rotated through the drive motor 110 to bring the track 105 into alignment with the track 104. When the holder 103*a* is centered on the turntable 109, as shown in FIG. 10, the eye end fitting 118 is disengeged to release the holder 103*a*, and the motor 110 is then energized to rotate the turntable 109 clockwise through 90° to align the track 105 with the track 107 on the second platform 116. The eye end fitting 118 of the piston rod 113*a* is then fastened to the holder 103*a* on the side of the platform 116 and the hydraulic cylinder 113 is activated to pull the holder 103*a* clear out of the turntable 109 onto the platform 116 through the tracks 107. Then, on the side of the platform 115, the eye end fitting of the piston rod 113*a* is secured to the clevis end fitting 118 on the holder 103*b* and the hydraulic cylinder 113 is operated to drive the holder 103*b* onto the turntable 109 through the track 106. The motor 110 is again energized to rotate the turntable 109 to bring its track 105 into alignment with the track 104 between the walls 133. The eye end fitting 118 of the piston rod 112*a* is then fastened to the holder 103*b* on the turntable 109, and the hydraulic cylinder 112 is actuated to guide the holder 103*b* into a normal operating position at the other end of the walls 133 along the track 104.

Although in this particular embodiment the hydraulic cylinders 112 and 113 move a roller holder along the tracks, this is only an example, and any other suitable drive system can be employed.

This changer system provides a quick and easy way of changing the set of multiple forming rollers as they are assembled on their holder, when the work requires spinning with a new or different combination of rollers.

The roller changer system in accordance with the present invention will be described in detail in conjunction with FIGS. 15 through 18. This roller changer system is employed as it is incorporated into a multiple roller spinning machine such as the one described above. Accordingly, in describing the construction and operation of the roller changer system, reference will be made to certain part of the spinning machine with which the system is integrated, particularly the roller holder. Detailed description of the machine itself will, however, be omitted where the previous description stands applicable.

The roller changer system of this invention includes a pair of horizontal parallel guiderails 214 adapted for a roller carrying holder 212 to slide along. An hydraulic cylinder 215 with an axially movable piston rod 215*a* capable of releasable coupling to the roller holder 212 is mounted on the spinning machine at one end of the guiderails 214. A frame 217 is mounted at the opposite end of the guiderails 214. A tiltable platform 201 is tiltably disposed on top of the frame 217, supported at its one end on a pair of aligned pivot pins 205. An hydraulic cylinder 218 is provided inside the frame 217 and operatively connected to the platform 201. A carriage 202 is mounted on top of the platform 201. The hydraulic cylinder 215 is adapted to move the holder 212 along the guiderails 214 between a first position where the holder normally operates on the spinning machine for drawing and a second position just above the frame 217. The holder 212 is transferred to its second position when its rollers are replaced. The hydraulic cylinder 218 has its axially movable piston rod 218*a* fixedly secured to the bottom of the platform 201 off-center such that, when the hydraulic cylinder 218 is activated, the platform is caused to tilt from its normal horizontal position, depicted in FIG. 15(C), into an inclined position, depicted in FIG. 15(A), where the platform is abutted against a pair of vertical stopper columns 219 that are provided inside the frame 217.

As best shown in FIG. 15(A), the carriage 202 has at opposite ends thereof at least one pair of bolt holes 209. Also, the platform 202 has at both ends thereof at least one pair of similar bolt holes 210 that are situated to align with the bolt holes 209, respectively.

The carriage 202 is moved on the platform 201 between a first position when the platform is held in its normal horizontal position and a second position when it is tilted in its inclined position by the hydraulic cylinder 218. When the carriage 202 is at its first position, it is situated at one end of the platform 201 adjacent the pivot pins 205, as shown in FIG. 15(A), and can be fixed in this position with a bolt 206 which may be inserted manually through the adjacent bolt holes 209 and 210. At its second position, the carriage 202 stands adjacent the opposite end of the platform 201, as shown in FIG. 15(F), to which the carriage can be rolled on wheels 208 down the surface of the platform 201 by tilting it, and can also be locked in this place with a bolt 206 screwed through the adjacent bolt holes 209 and 210. The platform 201 may preferably have at that opposite end a raised rim or stopper 201*a* which, as best shown in FIG. 15(D), serves to arrest the carriage 202 just in its second position, when it is allowed to wheel down the tilted platform surface.

The carriage 202 carries thereon a first and a second row 211 and 213 of sockets or seats. The rows are of identical construction to each other, and may preferably be divided into the same number of sockets as the number of rollers on a roller holder 212. The sockets in each row 211, 213 are adapted to receive therein the complete combination of different forming rollers, individually, of a holder 202, and, in this particular embodiment, consists of three sockets. However, this is only a matter of choice, and the row can have as many sockets as desired.

Figure 16:
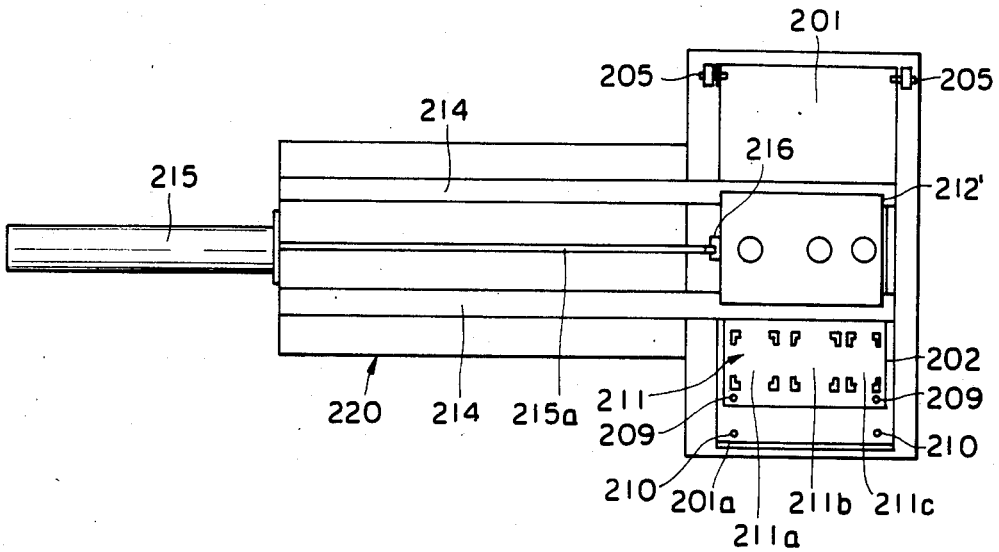
FIG. 16 is a top view of the main part of the automatic roller changer system of this invention.
Figure 17:
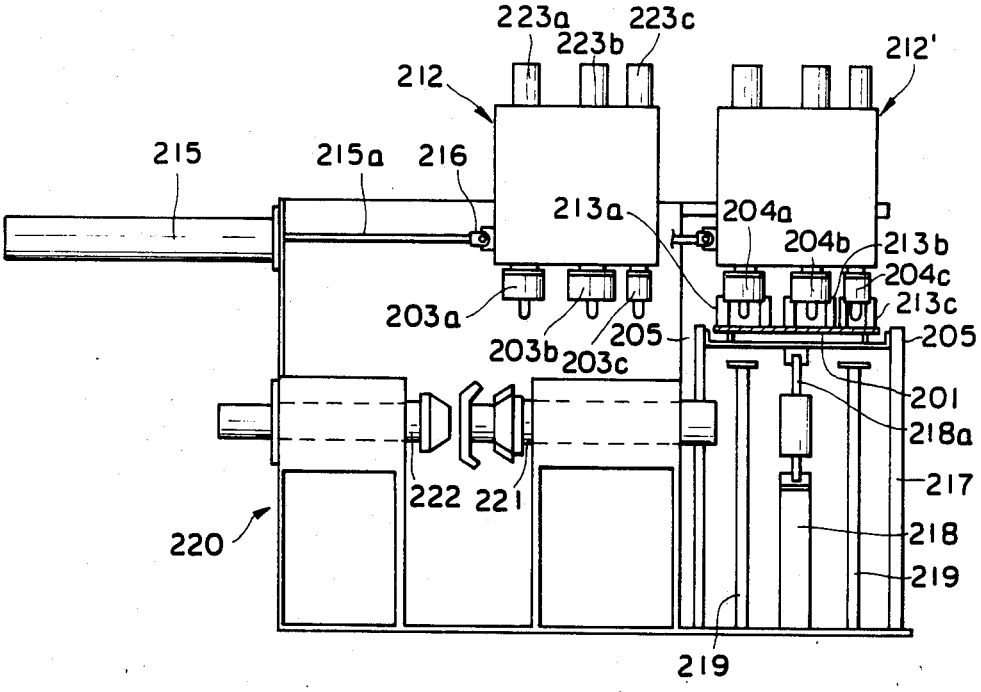
FIG. 17 is a side cross-section view of the system of FIG. 16.
Figure 18:
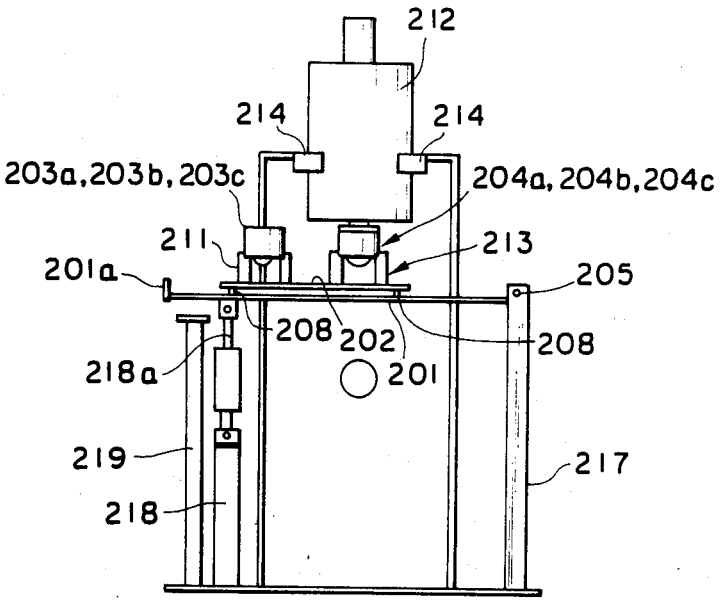
FIG. 18 is a front view of the system shown in FIG. 16.

It is so designed that, when the holder 212 is at its second position overlying the platform 201, the carriage 202, if in its first position, situates its first row 211 just below the rollers 203*a*, 203*b*, 203*c*, each facing its corresponding socket in the row 211, as shown in FIG. 17. Now, when the carriage 202 is moved to its second position, the second row 213 comes into just below the rollers of the holder, putting the first row 211 clear out of the holder, as shown in FIG. 16.

Operation of the roller changer system with the above arrangement will be described. When the rollers 203*a*, 203*b*, 203*c* of the holder 212 have to be replaced with a new or different set of rollers 204*a*, 204*b*, 204*c*, the hydraulic cylinder 215 is activated to move the holder 212 along the guiderails 214 into the second position above the platform 201, designated at 212' in FIG. 17. The replacing rollers 204*a*, 204*b*, 204*c* are properly seated, likely being arranged in the same sequence as the different rollers 203*a*, 203*b*, 203*c* on the holder, in the sockets of the second row 213, as shown in FIG. 15(A) in which the only one roller 204*a* is shown. The carriage 202 is fixed at its first position with the bolt 206 through the adjacent bolt holes 209, 210.

With the holder 212 held in this position, the bolts 207 secure each roller 203*a*, 203*b*, 203*c* to its shank 223*a*, 223*b*, 223*c* manually (FIGS. 15(B) and 15(C)). Released rollers are allowed to fall into the individual sockets of the first row 211. When all the rollers are disengaged, the bolt 206 is pulled out from the holes 209, 210 to release the carriage 202.

Next, the hydraulic cylinder 218 is activated to cause the platform 201 to tilt about the pivot pins 205 into its second inclined position allowing the carriage 202, with the disassembled rollers 203*a*, 203*b*, 203*c* in the row 211, to roll on wheels 208 down the tilted platform surface into its second position. To fix the carriage 202 in this second position, the bolt 206 is inserted into the adjacent bolt holes 209, 210, as shown in FIG. 15(D). At this point, the disassembled rollers may be removed from the carriage 202 for the convenience of subsequent operations.

Now, the carriage 202 places the replacement rollers 204*a*, 204*b*, 204*c* in the sockets of the second row 213 just below the shanks 223*a*, 223*b*, 223*c* of the holder 212. Again, the hydraulic cylinder 218 is operated to move the platform 201 back into its horizontal position so that the rollers in the row 213 come close to the connecting ends of their respective shanks on the holder. Following the procedure of disengaging rollers backward, the rollers 204*a*, 204*b*, 204*c* can easily be assembled into the holder.

In a more preferred embodiment, the overall design of the carriage 202 and its location at its first and second positions in the platform 201 are designed such that, when the platform 201 is at its horizontal position, the holder 212 in the second position at the frame 217 has its attached rollers precisely situated in position in the first row sockets of the carriage 202 when in the first position, as best indicated in FIG. 15(C), or its unequipped shanks 223*a*, 223*b*, 223*c*, precisely aligned with the corresponding replacement rollers that are pre-seated in the sockets of the second row when in the second position, as depicted in FIG. 15(F).

When all the replacement rollers 204*a*, 204*b*, 204*c* are assembled onto the holder 212 from the second row sockets, the carriage 202 is released from the second position and brought back to its first position adjacent the pins 205 for the subsequent procedure, and the hydraulic cylinder 215 is operated to bring the holder 212 back to its original operating position on the spinning machine for drawing operation.

Although the roller changer system is described in its incorporation into a multiple roller spinning machine of the type above stated, it can also efficiently be used on other spinning machines, with some corresponding change in design.

The automatic wheel material feed system of the spinning machine in accordance with the present invention will be described in conjunction with FIGS. 19 through 24.

In describing the construction and operation of this automatic feed system as it is integrated into a spinning machine such as the one described above, reference will naturally be made to certain parts of the machine, particularly the driving and driven spindles. However, detailed description of these parts will be omitted where the previous description of the same subject is applicable.

When the wheel material 324 is fed into the spinning machine for being spun, it is centered between the driving spindle 302 and the driven spindle 303. The driven spindle 303 is situated to stand in axial alignment with the driving spindle 302 and is slidably disposed for horizontal movement toward or away from the opposite spindle 302. The driven spindle 303 is caused to move forward to clamp the material 324 between the dies 326 and 327 provided at the opposing forward ends of the spindles 302 and 303, respectively. A hydraulic cylinder 311 is operatively coupled through a telescopic piston rod to the rear end of the driven spindle 303 and is operated to drive the spindle 303 in the horizontal direction. The numeral 328 indicates a drive for rotating the driving spindle 302 about its own axis.

Figure 19:
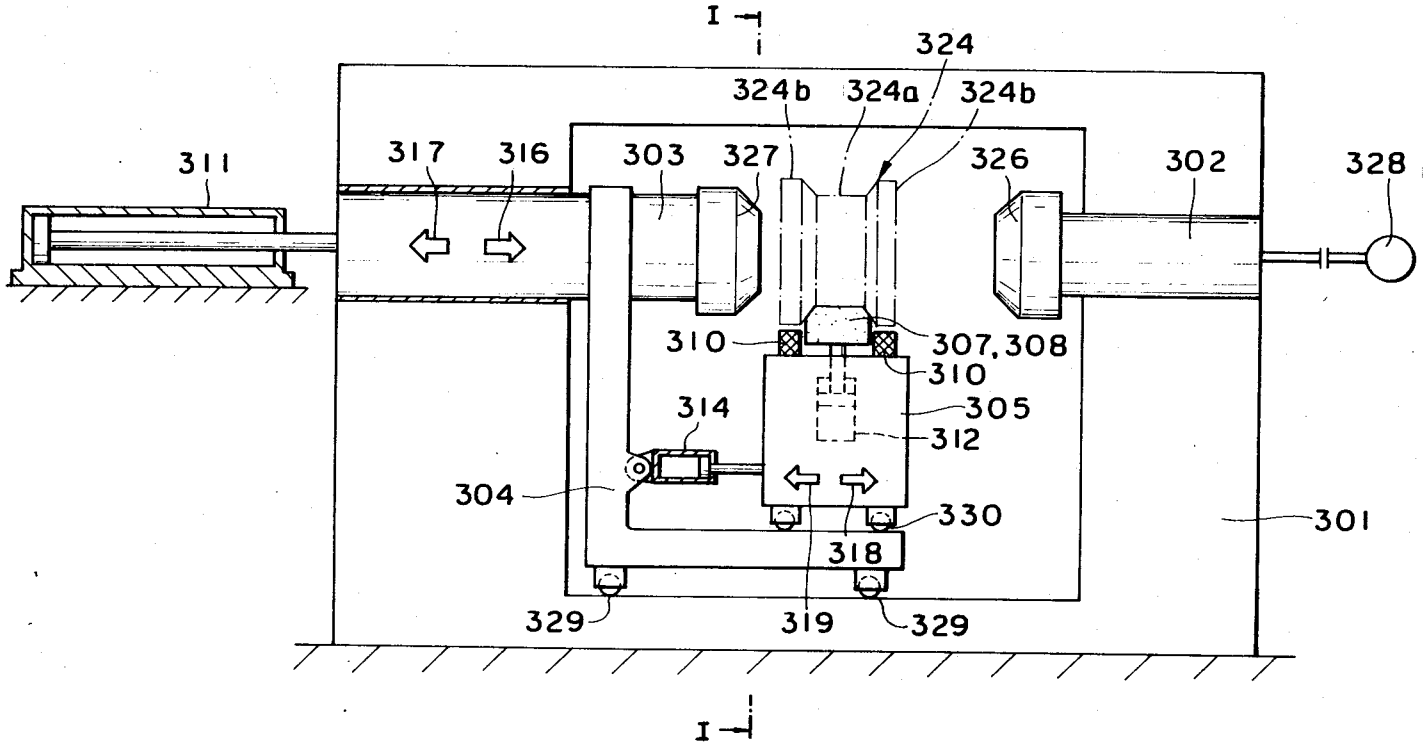
FIG. 19 is a side cross-section view of a preferred embodiment of the automatic wheel material feed system in accordance with the present invention, showing the fed wheel material located in position on a movable wheeled carriage.
Figure 21:
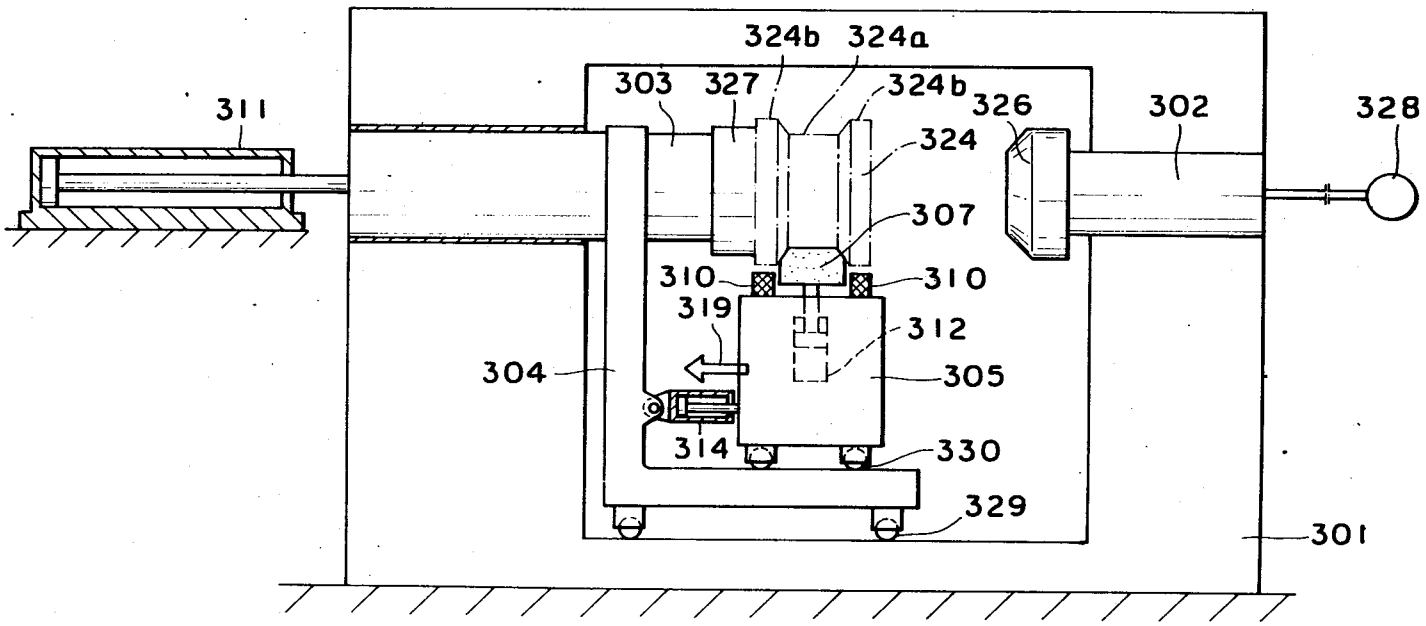
FIG. 21 is a side cross-section view of the system, showing the material just as such is being pressed against the driven spindle.

The automatic wheel material feed system incorporated into the spinning machine of the above general arrangement consists of a hand truck-like frame 304 of a largely L-cross section made integral at its upper part with the driven spindle 303 and a box-shaped dolly 305 adapted for the fed wheel material 324 to mount on top for spinning. The frame 304 has at its bottom a plurality of casters 329 so that it can freely move horizontally with the driven spindle 303 when driven by the hydraulic cylinder 311. The dolly 305 is also equipped with casters 330 which enable it to move in the same direction as the frame 304. A hydraulic cylinder 314 is secured in the frame 304 and has its axially movable piston rod coupled to the dolly 305. The hydraulic cylinder 314 is operated to move through its piston rod the dolly 305 closer or far away from the vertical righthand wall of the frame 304, as indicated by FIGS. 19 and 21.

Figure 20:
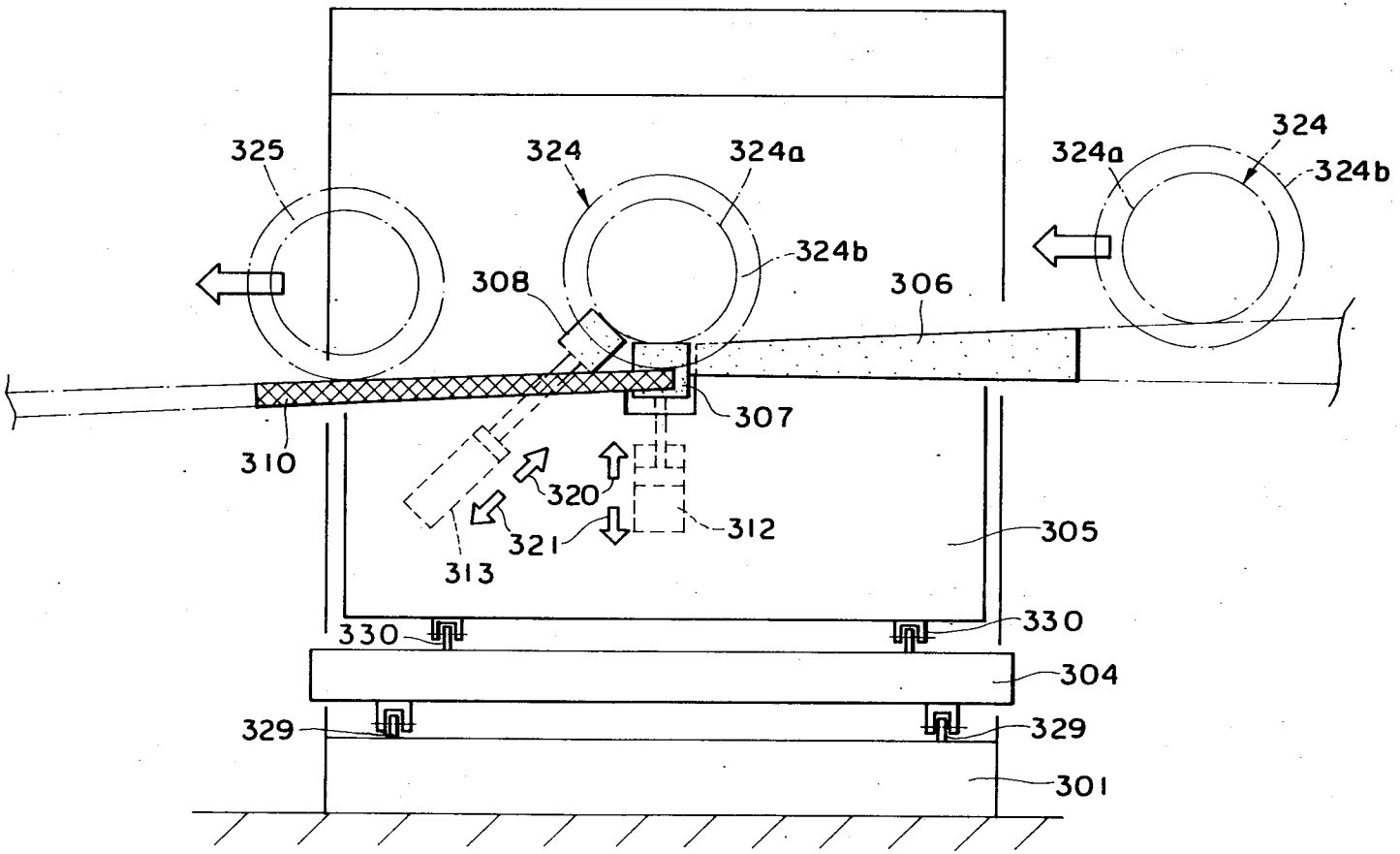
FIG. 20 is a front cross-section view of the system, taken along the line I—I of FIG. 19.
Figure 23:
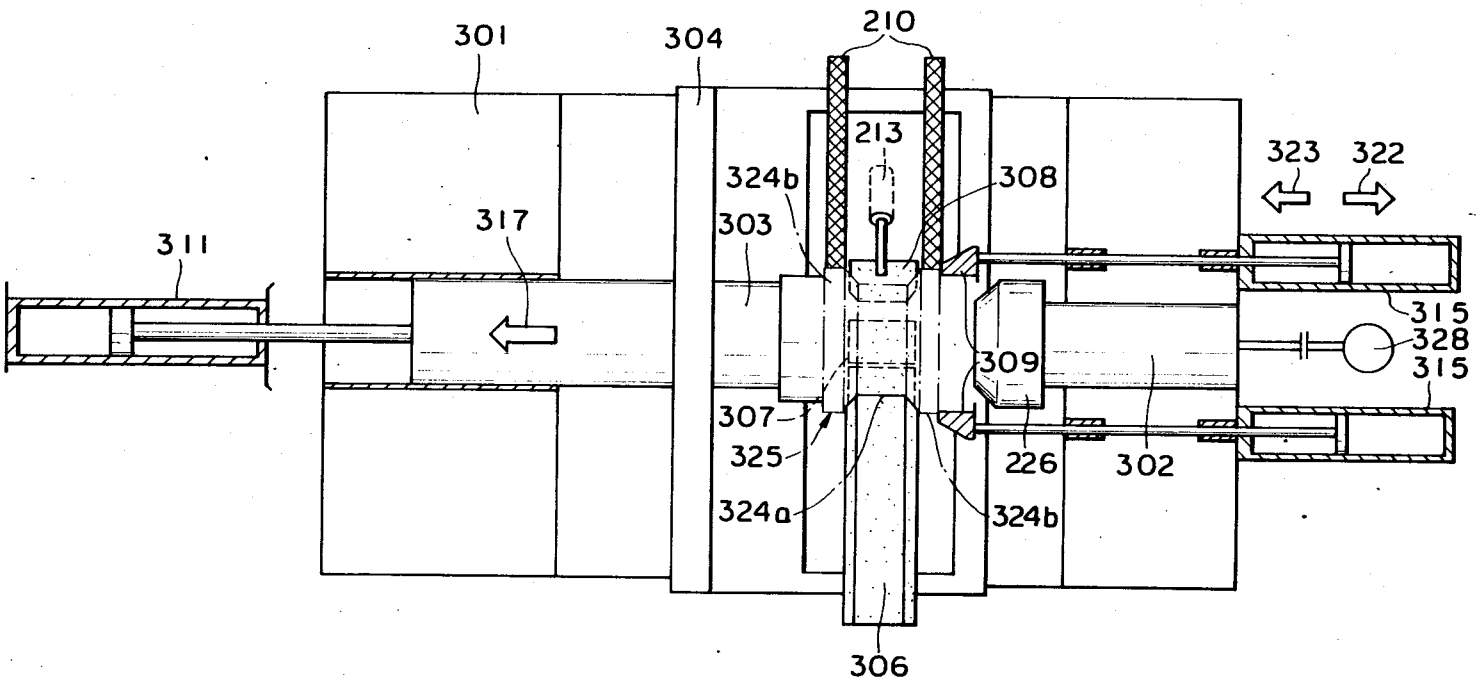
FIG. 23 is a top cross-section view of the system of FIG. 19 also showing the material between the spindles at the point when it is about to be released by the clamp.
Figure 24:
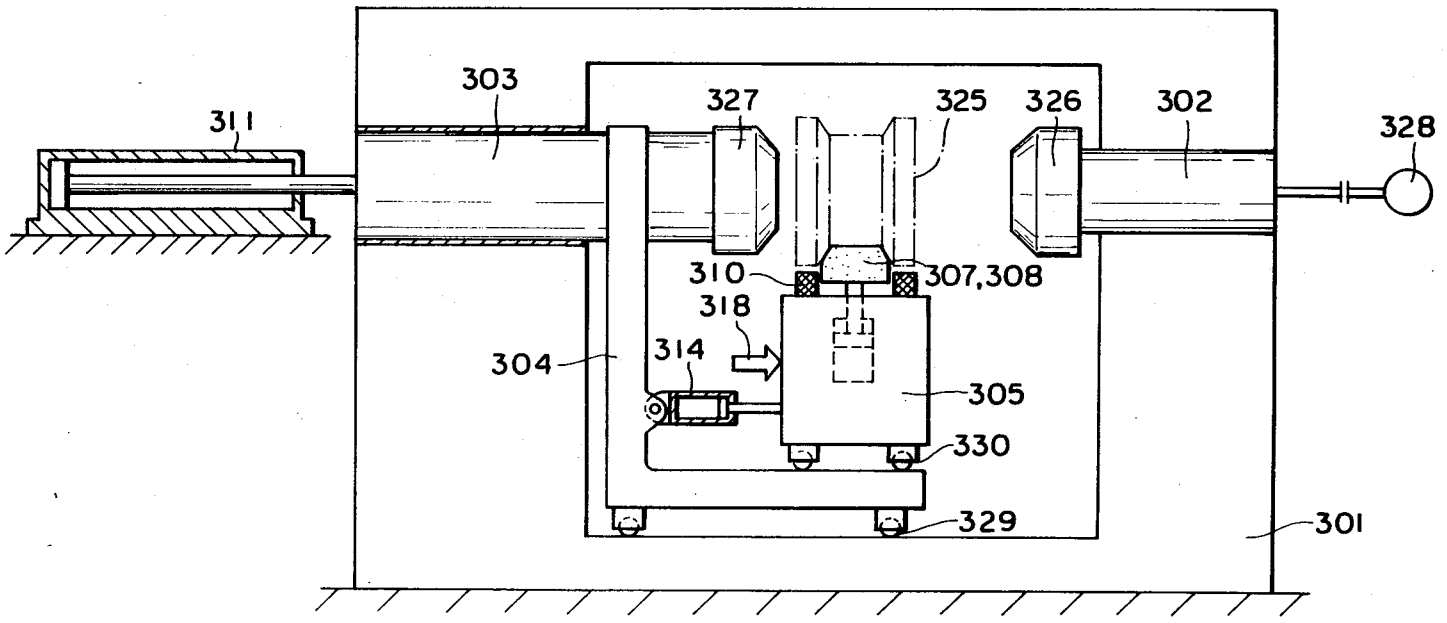
FIG. 24 is a side cross-section view of the system of FIG. 19 showing the material just being released by the clamp.

Referring then to FIGS. 20 and 23, a feed chute 306 is provided which extends into the spinning machine in a direction substantially perpendicular to the axis of the driving spindle 302. The feed chute 306 is disposed to be inclined at an angle and has its forward end situated just above the dolly 305, while its rear end is connected to a source (not shown) of wheel material. The feed chute 306 is adapted to supply to the dolly 305 wheel materials 324 one at a time. The feed chute 306 may be connected to the previous processing stage.

Also, a discharge chute 310 is provided which extends into the spinning machine to connect at its one end with the feed chute 306 in axial alignment. The discharge chute 310 also stands inclined at a proper angle such that, when a wheel material 324 is let go at a given point up along the feed chute 306, gravity causes it to roll of its own accord all the way through to the most remote end of the discharge chute 310.

A pair of stoppers 307 and 308 are provided in the dolly 305 adjacent to where the feed chute 306 meets the discharge chute 310. The stoppers 307, 308 are arranged in an angularly spaced-apart relationship with each other, as best shown in FIG. 20, and each has their bottom coupled through a telescopic piston rod with a hydraulic cylinder 312 and 313 which move the respective stopper between an upper and a lower position. It is so designed that, when the cylinders 312, 313 are both activated to bring the stoppers 307, 308 into their upper positions, the wheel material 324, if let go to roll down the feed chute 306, comes to a halt, arrested by the raised stoppers 307, 308, where its axis is correctly aligned with the axis of spinning between the driving and driven spindles 302, 303. This position is indicated by the middle circle in FIG. 20, and more precisely by the image in broken outline in FIG. 23.

Referring now to FIG. 23, a pair of hydraulic cylinders 315 are horizontally mounted, extending parallel with each other on both sides of the driving spindle 302. The hydraulic cylinders 315 have their axially movable piston rods formed to end in a sort of push rod. An action ring 309 is fixedly secured to the forward ends of the piston rods of the hydraulic cylinders 315. The ring 309 may preferably be sized to have substantially the same outside diameter as the wheel materials 324 spun on the machine, and they are slightly larger in inside diameter than the outside diameter of the die 326 so that the ring 309 can pass about the die 326. With this arrangement, when the hydraulic cylinders 315 are simultaneously activated to bring their piston rods to extend full length, in an axial direction indicated by the arrow 323, the ring 309 is abutted against the wheel material 324 clamped in position between the dies 326, 327, exerting pressure at its flanged rim 324*b*. The action ring 309 is provided to separate the wheel material 324 from the die 326 after the spinning, since roller drawing tends to cause the material to adhere hard to the face of the die 326.

Operation of the automatic feed system of this invention will now be described.

Figure 22:
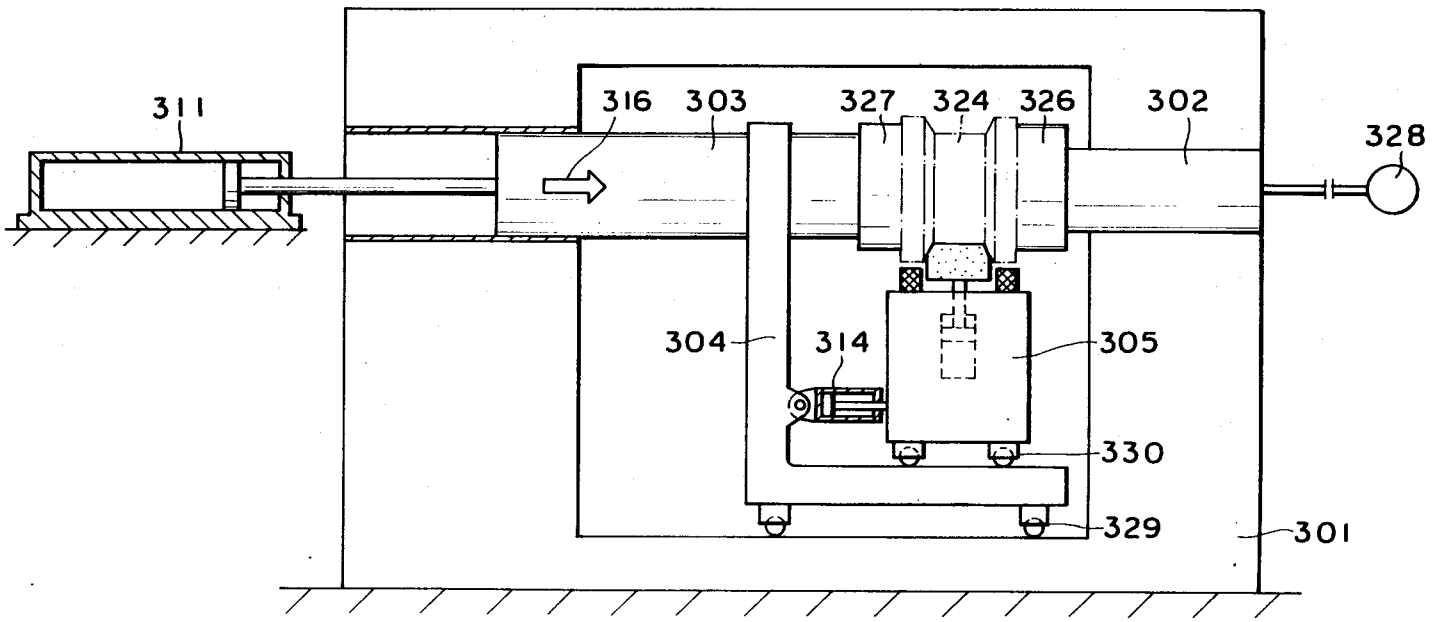
FIG. 22 is a side cross-section view of the system of FIG. 19 showing the material being clamped between the driving and driven spindle for spinning.

Prior to operation, the automatic feed system may be in its neutral position depicted in FIG. 19. First, when a wheel material 324 is supplied through the feed chute 306 into the spinning machine, it comes rolling and is stopped by the stoppers 307, 308 that have already been moved into their upper positions by the hydraulic cylinders 312, 313, at a position between the driving and driven spindles 302, 303, with its center being just aligned with the axis of spinning, on the dolly 305. Then, the hydraulic cylinder 314 is operated to move the dolly toward the vertical wall of the frame 304, in the direction indicated by the arrow 319 in FIG. 19, until the material 324 is tightly pressed against the die 327 at the driven spindle 303, with the flanged part 324*b* of the material enclosing about the die periphery. Next, the hydraulic cylinder 311 is activated to move the driven spindle 303 toward the driving spindle 302, in the direction indicated by the arrow 316 in FIG. 19, until the wheel material 324 is pressed at its opposite side against the die 326 at the driving spindle 302, as shown in FIG. 22.

Now, with the wheel material 324 clamped in position between the dies 326, 327, the spinning machine is run to perform the spinning operation, of which description will be omitted.

When the wheel material 324 is spun into a profiled wheel 325, the hydraulic cylinder 311 is operated to retract the driven spindle 303, in the direction indicated by the arrow 317 in FIG. 23 and, simultaneously, the hydraulic cylinders 315 are activated to cause the action ring 309 to force the wheel 325 away from the die 326. However, if the wheel 325 is left loose about the die 326 so as to be separated by the retracting movement of the spindle 303, the hydraulic cylinders 315 need not be used at all.

When the wheel 325 comes off from the die 326, the cylinders 315 are again operated to retract the action ring 309 back to home position. Next, the hydraulic cylinder 314 at the frame 304 is activated to move the dolly 305 away from the frame vertical wall, in the direction indicated by the arrow 318 in FIG. 19, allowing the wheel 325 to thereby be detached from the die 327.

Now, the wheel 325 stands on the dolly 305, free from the dies 326, 327. The hydraulic cylinders 312, 313 are then operated to cause the stoppers 307, 308 to move away from the wheel 325 into their lower positions, allowing the wheel 325 to roll down the inclined surface of the discharge chute 310.

When the hydraulic cylinders 312, 313 are again activated to bring the stoppers into their upper positions, the automatic feed system is set to an initial position, ready to receive the next wheel material 324 in the queue. In this manner, the same procedure is repeated to process large numbers of wheel materials in full-automatic mass-scale production, with resultant enhanced efficiency and increased productivity.

It should readily be understood from the foregoing that the multiple roller spinning machine of FIG. 1 can achieve a sequence of different steps from rough to finishing drawing determined by the number of different forming rollers assembled in set on the roller holder, continuously and efficiently, without the conventional cumbersome changing of rollers, one after another, as the steps progress. Also, the rollers are capable of shifting in the direction perpendicular to the axis of spinning, and they can draw a wider range than their size across the U-cross section portion of the wheel material rim, thus enhancing the versatility of the individual rollers in shaping.

Further, since the multiple rollers permit adjustment of the pressure with which they are pressed against the wheel material rim individually, independently of one another, the spinning machine can, as a whole, increase elaboration and workmanship.

The multiple roller spinning machine of FIG. 6 in which the holder carries multiple axial rows of rollers, arranged radially about a common center, can, besides the above advantages of the above spinning machine, enhance the overall spinning capacity owing to the increased number of forming rollers, thereby further decreasing production time. In addition, the range of drawing modes can be expanded by selective operation of the roller rows in a different combination.

In addition, the multiple roller changer spinning machines of FIGS. 1 and 6 can further be enhanced in versatility and efficiency by incorporation of the roller holder changer system of FIG. 7 or the roller changer system of FIG. 7 and/or the automatic feed system of FIG. 19.

The roller holder changer system enables the multiple rollers to be changed as they are assembled in the roller holder, thus considerably decreasing the time required while increasing the safety and efficiency of changing operation, with a resultant marked increase in productivity. Also, the system eliminates the conventional use of cranes or other carrier means for dismounting and reinstalling the holder, thereby reducing peripheral costs. Further, since the system can have its changer bench situated close the spinning machine itself, various adjustments and coordinations between the main machine and the holder become possible.

The roller changer system has many of the advantages and features of the above roller holder changer system. Further, in this system, disassembling and fitting the individual roller into the holder becomes a very easy and safe operation, as it is done with the roller fittingly seated in a supported socket. In addition, since the replaced rollers are shoved off into open area in the changer platform, they can easily be taken away, probably with a crane, so that the subsequent operations can be facilitated.

The automatic feed system of this invention can efficiently achieve the complete cycle of feeding work, centering it in position between the dies, and, after spinning, removing it out of the machine, in a fully automatic manner, with a resultant considerable reduction in cost and a marked increase in speed and productivity. Also, the system can readily be incorporated into spinning machines and, since it can be constructed so as to be small in size, the entire spinning facility is made conpact. In addition, the action ring and the hydraulically actuated wheeled dolly are provided to contribute greatly to enhancing the efficiency of the machine by generating a force to detach the wheel material, at the end of the spinning, from the dies, since the material tends to adhere to the die surface owing to the pressure of the roller drawing.

If is therefore apparent that the present invention is one well adapted to attain all of the objects and advantages that will become obvious and inherent from a description of the apparatus. Also, it will be understood that certain combinations of the disclosed features are of utility and may be employed without reference to other combinations. This is contemplated by and is within the scope of the appended claims.

As many possible embodiments may be made of this invention without departing from the spirit or scope thereof, it is to be understood that all matters hereinabove set forth or shown in the accompanying drawings are to be interpreted as illustrative and not in any limited sense.

What is claimed is:

1. A multiple roller spinning machine for spinning vehicle wheels, said spinning machine comprising:

(a) a driving spindle rotatable about a first axis;

(b) first means for rotating said driving spindle about said first axis;

(c) a driven spindle rotatable about said first axis;

(d) second means for moving said driven spindle towards said driving spindle so as to grip material to be spun therebetween and for moving said driven spindle away from said driving spindle so as to release the material after it has been spun;

(e) a roller holder body having a plurality of guide bores therethrough, each one of said plurality of guide bores having an axis that is perpendicular to and that intersects said first axis, said plurality of guide bores being spaced axially along said first axis;

(f) a plurality of roller shanks, each one of said plurality of roller shanks being slidably mounted in a corresponding one of said plurality of guide bores;

(g) a plurality of different forming rollers, each one of said plurality of different forming rollers being sized and shaped to perform a different step in the spinning of vehicle wheels and each one of said plurality of different forming rollers being releasably mounted on the distal end of a corresponding one of said plurality of roller shanks;

(h) a plurality of independent control hydraulic cylinders, each one of said plurality of independent control hydraulic cylinders being coupled to a corresponding one of said plurality of roller shanks and adapted to move said corresponding one of said plurality of roller shanks between a retracted position and an active position in which the corresponding one of said plurality of different forming rollers is pressed against the periphery of material to be spun gripped between said drive spindle and said driven spindle; and (i) an actuation hydraulic cylinder operably connected to said roller holder body so as to move said roller holder body back and forth in a direction parallel to said first axis, whereby:

(j) during use of said multiple roller spinning machine, said actuation hydraulic cylinder is operated to move said roller holder body, thereby bringing each one of said plurality of different forming rollers sequentially into an operating position, and, (k) during the use of said plurality of different forming rollers, each one of said plurality of different forming rollers can be moved in a direction parallel to said first axis, thereby working an axial length of the material being spun greater than the axial width of said each one of said plurality of different forming rollers.

2. A multiple roller spinning machine as recited in claim 1 comprising at least one additional roller holding body as recited in claim 1 and associated pluralities of roller shanks, different forming rollers, and control hydraulic cylinders, whereby said different forming rollers associated with each one of said roller holding bodies can act on material gripped by said drive spindle and said driven spindle either simultaneously or sequentially.

3. A multiple roller spinning machine as recited in claim 1 wherein the axes of said plurality of guide bores are parallel to one another.

* * * * *